US007376369B2

(12) United States Patent
Yamada et al.

(10) Patent No.: US 7,376,369 B2
(45) Date of Patent: May 20, 2008

(54) SEALING MEMBER, TONER ACCOMMODATING CONTAINER AND IMAGE FORMING APPARATUS

(75) Inventors: Yusuke Yamada, Moriya (JP); Yutaka Ban, Tokyo (JP); Katsuya Murakami, Toride (JP); Fumio Tazawa, Abiko (JP); Hironori Minagawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/567,976

(22) Filed: Dec. 7, 2006

(65) Prior Publication Data

US 2007/0092304 A1 Apr. 26, 2007

Related U.S. Application Data

(60) Division of application No. 11/200,179, filed on Aug. 10, 2005, which is a division of application No. 10/429,741, filed on May 6, 2003, now Pat. No. 6,990,301, which is a continuation-in-part of application No. 10/076,430, filed on Feb. 19, 2002, now Pat. No. 6,879,789.

(30) Foreign Application Priority Data

Feb. 19, 2001 (JP) ..... 2001-042536
Jun. 28, 2001 (JP) ..... 2001-197546

(51) Int. Cl.
*G03G 15/08* (2006.01)

(52) U.S. Cl. ..... 399/106; 399/262

(58) Field of Classification Search ..... 399/262, 399/106, 119, 120; 222/DIG. 1
See application file for complete search history.

(56) References Cited

U.S. PATENT DOCUMENTS 4,060,105 A 11/1977 Feldeisen et al. ..... 222/DIG. 1

(Continued)

FOREIGN PATENT DOCUMENTS

CA 2300202 2/1999

(Continued)

OTHER PUBLICATIONS

Konica Parts Catalog, Model 7020, 1st Edition, Feb. 2000, CMPC-7020, Konica Business Technologies, Inc., and six (6) sheets of annolated illustrations and photographs of Konica 7020 and 8050 toner bottle along with a cover sheet.

(Continued)

*Primary Examiner*—Susan S Lee
(74) *Attorney, Agent, or Firm*—Fitzpatrick, Cella, Harper & Scinto

(57) ABSTRACT

A sealing member for sealing a toner discharge opening of a toner accommodating container detachably mountable to an image forming apparatus, the sealing member includes a locking portion for being locked with a portion to be locked provided in the image forming apparatus, the locking portion being adapted to displace with a relative closing movement relative to the portion to be locked, wherein the toner discharging opening is brought into an open state from a closed state by relative to movement of the sealing member relative to the toner accommodating container with the locking portion being in engagement with the portion to be locked; and a releasing force receiving portion for receiving from the image forming apparatus a releasing force for releasing engagement between the locking portion and the portion to be locked by displacing the locking portion.

2 Claims, 34 Drawing Sheets

U.S. PATENT DOCUMENTS

| | | | | |
|---|---|---|---|---|
| 4,342,282 | A | 8/1982 | Yamashita et al. | 399/106 |
| 4,981,218 | A | 1/1991 | Ban et al. | 206/633 |
| 5,177,539 | A | 1/1993 | Tsuji | 399/281 |
| 5,177,540 | A | 1/1993 | Honda et al. | 399/106 |
| 5,268,722 | A | 12/1993 | Ikkatai et al. | |
| 5,351,728 | A | 10/1994 | Ban et al. | 141/364 |
| 5,513,679 | A | 5/1996 | Yamada | 141/364 |
| 5,515,143 | A * | 5/1996 | Shiotani | 399/106 |
| 5,528,349 | A | 6/1996 | Satake | 399/262 |
| 5,579,101 | A | 11/1996 | Omata et al. | |
| 5,794,108 | A | 8/1998 | Yoshizawa et al. | 399/262 |
| 5,828,935 | A | 10/1998 | Tatsumi et al. | 399/260 |
| 5,870,652 | A | 2/1999 | Kanamori et al. | 399/106 |
| 5,890,040 | A | 3/1999 | Matsuoka et al. | 399/262 |
| 5,907,756 | A | 5/1999 | Shirota et al. | |
| 5,918,095 | A | 6/1999 | Huang | |
| 6,032,013 | A | 2/2000 | Nizawa | 399/262 |
| 6,049,685 | A | 4/2000 | Murakami et al. | 399/263 |
| 6,064,846 | A | 5/2000 | Wang | 399/262 |
| 6,067,432 | A | 5/2000 | Huang | 399/262 |
| 6,075,963 | A | 6/2000 | Ichikawa et al. | 399/262 |
| 6,091,912 | A | 7/2000 | Kitajima et al. | 399/119 X |
| 6,118,951 | A | 9/2000 | Kato et al. | 399/258 X |
| 6,128,453 | A | 10/2000 | Ban et al. | 399/106 |
| 6,131,008 | A | 10/2000 | Kanamori et al. | 399/263 |
| 6,137,972 | A | 10/2000 | Playfair et al. | 399/106 |
| 6,151,432 | A | 11/2000 | Nakajima et al. | |
| 6,151,471 | A | 11/2000 | Yahata et al. | 399/258 |
| 6,224,270 | B1 | 5/2001 | Nakajima et al. | |
| 6,259,874 | B1 | 7/2001 | Murakami et al. | 399/120 |
| 6,266,505 | B1 | 7/2001 | Ban et al. | 399/258 |
| 6,289,193 | B1 | 9/2001 | Ban et al. | 399/258 |
| 6,292,644 | B1 | 9/2001 | Goto et al. | 399/262 |
| 6,314,261 | B1 | 11/2001 | Omata et al. | 399/258 |
| 6,533,468 | B2 | 3/2003 | Nakajima et al. | |
| 6,766,133 | B1 | 7/2004 | Ban et al. | 399/258 |
| 6,879,789 | B2 | 4/2005 | Yamada et al. | 399/106 |
| 6,920,298 | B2 | 7/2005 | Yamada et al. | 399/106 |
| 6,944,417 | B2 | 9/2005 | Yamada et al. | 399/263 |
| 6,950,621 | B2 | 9/2005 | Himes | 399/262 |
| 6,990,301 | B2 | 1/2006 | Yamada et al. | 399/106 |
| 6,990,302 | B2 | 1/2006 | Toba et al. | 399/106 |
| 2004/0009017 | A1 | 1/2004 | Yoshino et al. | 399/262 |
| 2005/0047818 | A1 | 3/2005 | Yamada et al. | 399/106 |

FOREIGN PATENT DOCUMENTS

| | | |
|---|---|---|
| CN | 1237405 C | 1/2006 |
| EP | 0 853 260 A2 | 7/1998 |
| EP | 1 006 415 A1 | 6/2000 |
| JP | 63-135359 | 9/1988 |
| JP | 1-29745 | 9/1989 |
| JP | 03-256058 | 11/1991 |
| JP | 4-112474 | 9/1992 |
| JP | 5-75768 | 3/1993 |
| JP | 5-75768 | 10/1993 |
| JP | 8-211719 | 8/1996 |
| JP | 9-222786 | 8/1997 |
| JP | 09-274366 | 10/1997 |
| JP | 10-48936 | 2/1998 |
| JP | 10-63076 | 3/1998 |
| JP | 10-63084 | 3/1998 |
| JP | 10-63084 | 6/1998 |
| JP | 11-2744 | 1/1999 |
| JP | 11-73000 | 3/1999 |
| JP | 11-73001 | 3/1999 |
| JP | 11-73002 | 3/1999 |
| JP | 11-102109 | 4/1999 |
| JP | 2002-42384 | 10/2001 |
| JP | 2002-318490 | 10/2002 |

OTHER PUBLICATIONS

Invitation to Respond to Written Opinion, dated Jan. 14, 2008, issued in Singapore counterpart Application No.: 200602933-4, including an Austrian Search Report and Written Opinion dated Dec. 14, 2007.

* cited by examiner (A)

(B)

(A)

(B)

(C)

SEALING MEMBER, TONER ACCOMMODATING CONTAINER AND IMAGE FORMING APPARATUS

The present application is a divisional application of application Ser. No. 11/200,179, filed Aug. 10, 2005, which is a divisional application of application Ser. No. 10/429,741, filed May 6, 2003, which issued as U.S. Pat. No. 6,990,301 B2, and which is a continuation-in-part application of application Ser. No. 10/076,430 filed Feb. 19, 2002, which issued as U.S. Pat. No. 6,879,789 on Apr. 12, 2005.

FIELD OF THE INVENTION AND RELATED ART

The present invention relates to a toner accommodating container, a sealing member therefor and an image forming apparatus, suitably usable with an image forming apparatus such as a copying machine, a printer, facsimile machine.

In a conventional electrophotographic image forming apparatus such as an electrophotographic copying machine or a printer, fine particles toner is used as a developer. When the toner in the main assembly of the electrophotographic image forming apparatus is used up, the toner is supplied into the main assembly of the image forming apparatus using a toner accommodating container (toner supply container).

Here, the electrophotographic image forming apparatus is an apparatus which forms images on a recording material through an electrophotographic image formation type process. The electrophotographic image forming apparatus includes a, an electrophotographic copying machine, an electrophotographic printer (laser beam printer, LED printer, for example), a facsimile machine, word processor or the like.

Since the toner is very fine powder, it is known to place, upon toner supplying operation, a toner supply container inside the main assembly of the image forming apparatus and to gradually supply the toner through a small opening to avoid scattering of the toner.

Any one of the above-described toner supply containers receives a driving force from the main assembly of an image forming apparatus to drive the feeding member in the toner supply container or the main body itself to discharge the toner. As for such a drive transmitting means, there are some methods. For example, Japanese Laid-Open Utility Model Application Hei 05-75768 discloses that gear portion is provided on an outer surface of the toner bottle (toner supply container), and the gear is engaged with a driving gear, by which the toner bottle is rotated.

Japanese Laid-open Patent Application Hei 10 -63084 discloses that end surface of the toner bottle is provided with a projection, which is engaged with a recesses formed in a driving portion of the main assembly of the image forming apparatus, thus transmitting the driving force.

Japanese Laid-open Patent Application Hei 10 -63076 discloses another type. A rotating force transmitting portion of the main assembly of image forming apparatus has an inner diameter which is provided with a plurality of engaging grooves, and the toner container is provided with projections engageable with the engaging grooves. The rotational driving force is transmitted through the engagement therebetween.

As described, various drive transmission methods are proposed for driving the toner supply container.

However, the conventional structures involve some problems.

In the case of Japanese Laid-Open Utility Model Application Hei 05-75768, when the toner bottle is inserted into the main assembly of the image forming apparatus, it is necessary to make the gear portion on the outer surface of the toner bottle properly engage with the driving gear portion in the main assembly of image forming apparatus. This requires the user to be careful for the proper engagement. In addition, since the toner bottle is rotated through the meshing engagement between gears, the toner bottle receives forces tending to deviate the bottle in a direction perpendicular to the axis. Therefore, there is a possibility that toner bottle is raised or is laterally deviated with a result of improper rotation. In other to avoid such a deviation, it is required that entire outer circumference of the toner bottle is enclosed. This imposes difficulty in the toner bottle mounting and mounting operation. Additionally, the supplying system becomes complicated and inexpensive.

In the methods disclosed in Japanese Laid-open Patent Application Hei 10 -63084 and Japanese Laid-open Patent Application Hei 10 -68076, when the toner bottle is inserted such that projection (or recess) provided at the end surface of toner bottle is properly engaged with the basis (or projection) of the main assembly side driving portion (main assembly driving portion), an indexing operation in the rotational direction is required. This degrades the developer supplying operativity, and even a slight deviation may result in an inoperability.

In order to avoid such an improper engagement, it is required that toner bottle is provided on its outer surface with a guiding rib so as to determine the position of the toner bottle in the rotational direction upon the insertion thereof, or that rotating operation of the engaging recess of the main assembly driving portion is controlled to stop at a predetermined rotational position whenever it stops. This also result in complication and cost increase.

In most of the coupling drive transmission using projection/recess engagement, when the phase deviation occurs between the toner bottle and the main assembly driving portion, it is required that main assembly driving portion is retracted against a spring force, and the engaging position is established when the phase becomes aligned. With such a structure, even if there is a phase difference when the toner bottle is inserted, the main assembly driving portion is retracted, and when the bottle is rotated with the state, the face differences is eliminated sooner or later, and therefore, the engagement is established. However, the structure of the main assembly driving portion is complicated. In addition, the main assembly driving portion has to be movable toward the rear side, which requires an additional space and therefore hinder downsizing of the main assembly of the apparatus.

In the conventional example, it is not disclosed as to how to disengage the projection from the recess. Assuming that operator forces to pull the toner supply container out, or the operator pushes the small projection by the finger, the usability is not good, or the driving portion of the image forming apparatus or the toner supply container may be damaged.

SUMMARY OF THE INVENTION

Accordingly, it is a principal object of the present invention to provide a sealing member in which a sealing member is locked with an image forming apparatus in order to open or unseal a toner discharge opening of a toner accommodating container, and yet the sealing member can be released from the image forming apparatus with a simple structure.

It is another object of the present invention to provide a toner accommodating container in which a locking portion of the toner accommodating container is locked with an image forming apparatus, and it the locking of the locking portion with the image forming apparatus can be released with a simple structure.

It is a further object of the present invention to provide a toner accommodating container in which a sealing member is locked with an image forming apparatus to open or unseal a toner discharge opening of the toner accommodating container, and yet the sealing member can be released from the image forming apparatus with a simple structure.

It is a further object of the present invention to provide an image forming apparatus in which a locking portion of a toner accommodating container is engaged with a portion to be locked of mounting means, and it the locking portion can be released from the portion to be locked with a simple structure.

It is a further object of the present invention to provide an image forming apparatus in which a locking portion of a sealing member is engaged with a portion to be locked of the mounting means to open or unseal a toner discharge opening of a toner accommodating container, and yet the locking portion can be released from the portion to be locked with a simple structure.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A sealing member, a toner accommodating container and an image forming apparatus according to the preferred embodiments of the present invention will be described in conjunction with the accompanying drawings.

Embodiment 1

Figure 1:
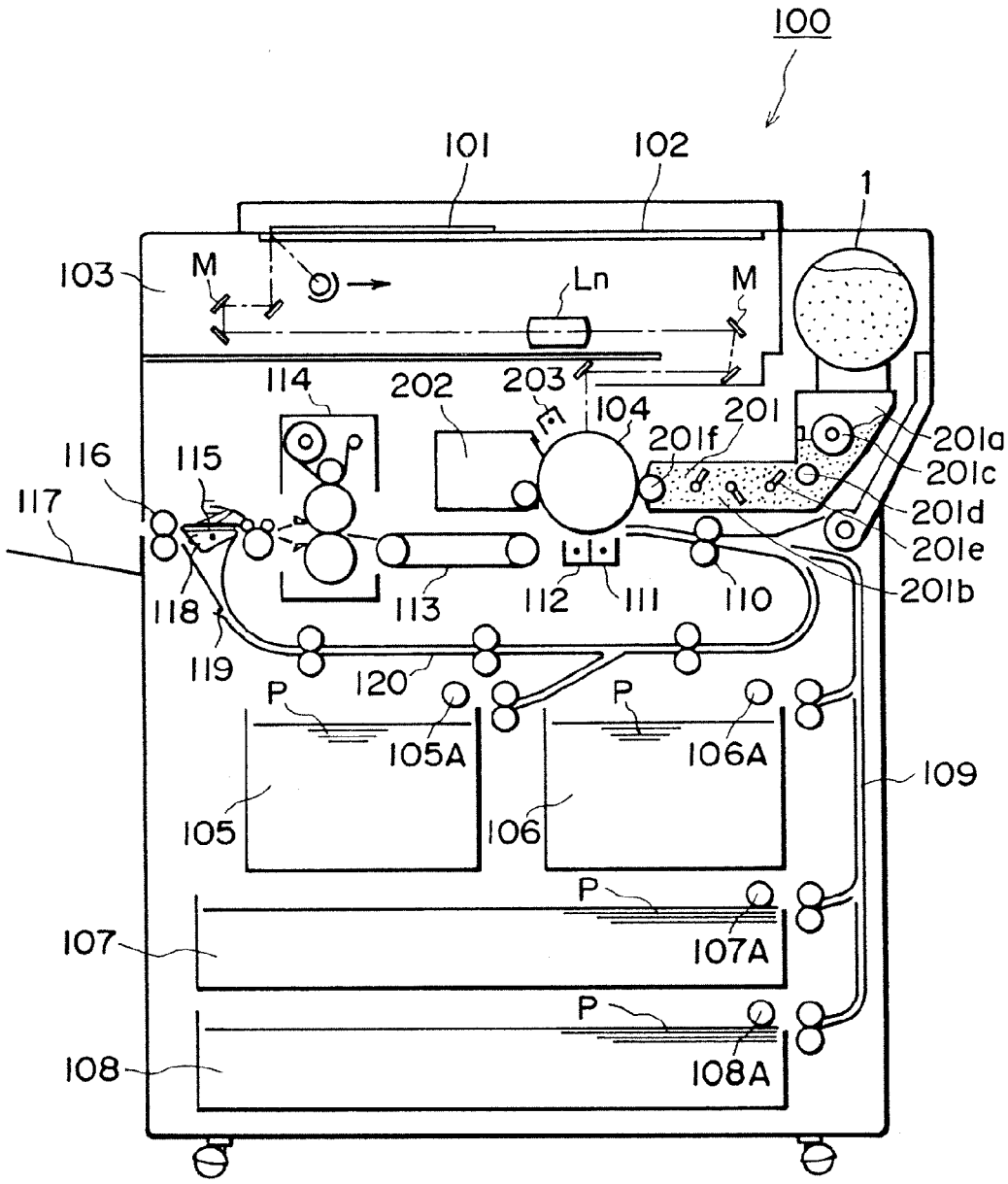
FIG. 1 is a sectional view of an image forming apparatus according to an embodiment of the present invention.

Referring to FIG. 1, the description will first be made as to an electrophotographic image forming apparatus which is an exemplary image forming apparatus to which a toner supply container (toner accommodating container) according to an embodiment of the present invention.

(Electrophotographic Image Forming Apparatus)

FIG. 1 shows an electrophotographic copying machine. An original 101 in a main assembly (main assembly of apparatus) 100 is placed on an original supporting platen glass 102. A light image corresponding to the image information of the original 101 is image on an electrophotographic photosensitive drum (image bearing member) 104 through a plurality of mirrors M and a lens Ln of an optical portion 103. On the basis of selection by the user on an operating portion 100*a* shown in FIG. 2 or on the basis of automatic selection in accordance with the paper size of the original 101, an optimum sheet P is selected from the cassettes 105, 106, 107, 108. The recording material is not limited to the sheet of paper, but may be an OHP sheet, for example.

A single sheet P supplied from one of separating devices 105A, 106A, 107A, 108A, is fed to registration rollers 110 by way of a feeding portion 109, and the sheet P is fed to the transfer portion by the registration rollers 110 in synchronism with the rotation of the photosensitive drum 104 and the scanning timing of the optical portion 103. In the transfer portion, a toner image formed on the photosensitive drum 104 is transferred onto the sheet P by the transfer discharger 111. The sheet P now having the transferred toner image is separated from the photosensitive drum 104 by a separation discharger 112.

The sheet P is fed into a fixing portion 114 by a feeding portion 113. In the fixing portion 114, the toner image is fixed on the sheet P by heat and pressure. Thereafter, the sheet P is passed through a discharged sheet reversing portion 115 and discharged to a sheet discharge tray 117 by sheet discharging rollers 116 in the case of a one sided copy mode. In the case of a duplex copy mode, the sheet P is refed to the registration rollers 110 through sheet refeeding paths 119, 120, under the control of a flapper 118 provided in the discharged sheet reversing portion 115. Then, the sheet is fed similarly to the case of the one-sided copy mode, and is finally discharged to the sheet discharge tray 117.

In the case of a superimposed copy mode, the sheet P is temporarily and partly discharged by the sheet discharging rollers 116 through the discharged sheet reversing portion 115. Thereafter, at the timing when the trailing edge of the sheet passes by the flapper 118 while it is still nipped by the sheet discharging rollers 116, the flapper 118 is controlled, and the sheet discharging roller 116 is rotated in the reverse direction, so that it is refed into the main assembly 100. Thereafter, the sheet is fed to the registration rollers 110 through the sheet refeeding portions 119, 120, and then the sheet is processed similarly to the case of the one-sided copy mode. It is finally discharged to the sheet discharge tray 117.

In the main assembly 100 of apparatus, there are provided a developing device 201 (developing means), a cleaning device 202, the primary charger 203 and so on, around the photosensitive drum 104.

An electrostatic latent image is formed by exposing the photosensitive drum 104 uniformly to double to the image light corresponding to the image information of the original 101. The electrostatic latent image is developed with toner by a developing device 201. In order to supply the toner (developer) into the developing device 201, a toner supply container 1 is detachably mountable by the user into the main assembly 100 of apparatus. The present invention needs applicable to the case in which only the toner is supplied into the image forming apparatus from the toner supply container and to the case in which the toner and carrier are supplied therefrom. In this embodiment, the former is the case.

The developing device 201 comprises a toner hopper 201*a* (accommodating means) and a developing device 201*b*. The toner hopper 201*a* is provided with a stirring member 201*c* for stirring the toner supply designated from the toner supply container 1. The toner stirred by the stirring member 201*c* is supplied into the developing device 201*b* by a magnet roller 201*d*. The developing device 201*b* comprises a developing roller 201*f* and a feeding member 201*e*. The toner fed from the toner hopper 201*a* by the magnet roller 201*d* is fed to the developing roller 201*f* by the feeding member 201*e*, and it supplied to the photosensitive drum 104 by the developing roller 201*f*.

The cleaning device 202 functions to remove the toner remaining on the photosensitive drum 104. The primary charger 203 functions to electrically charge the photosensitive drum 104.

Figure 2:
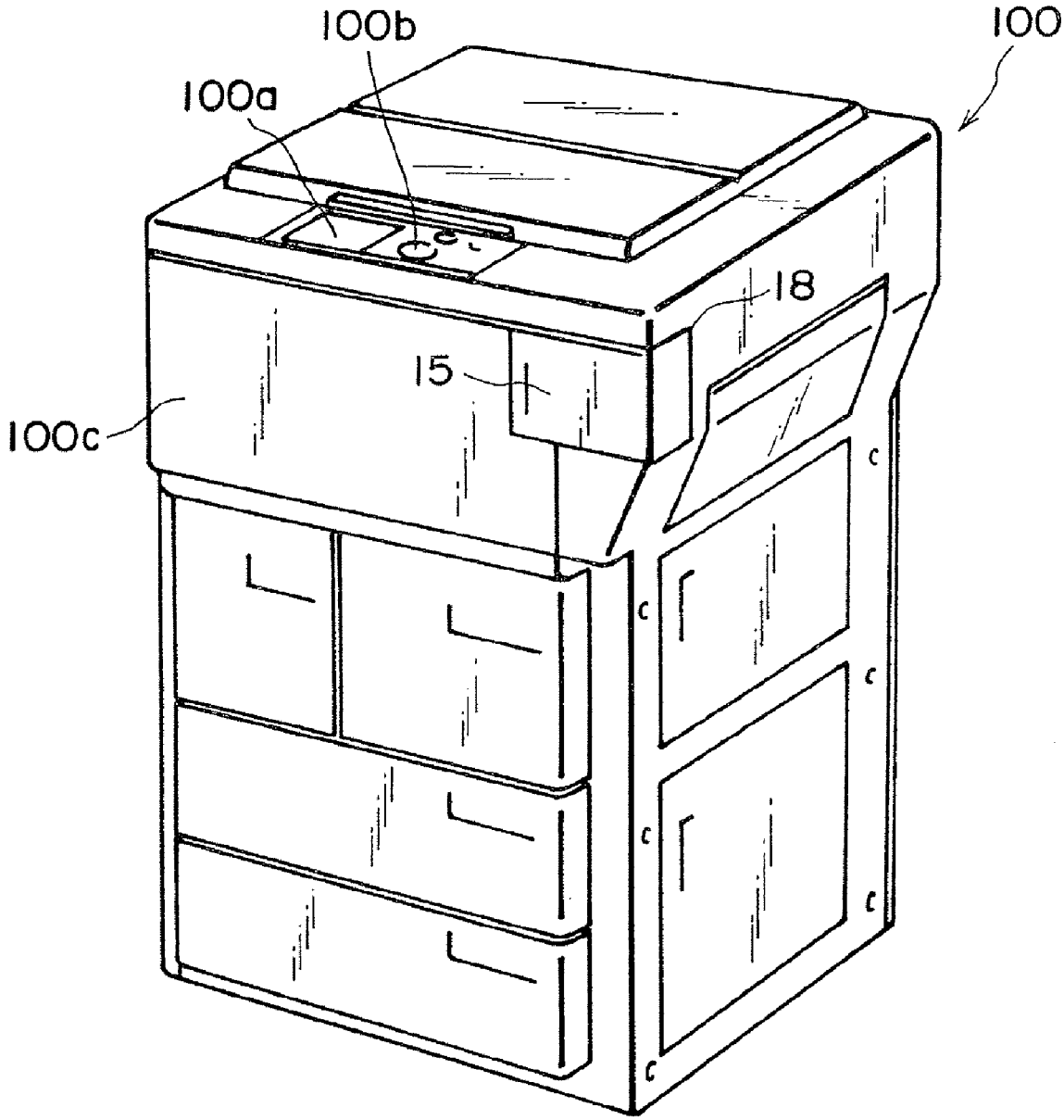
FIG. 2 is a perspective view of the image forming apparatus shown in FIG. 1.
Figure 3:
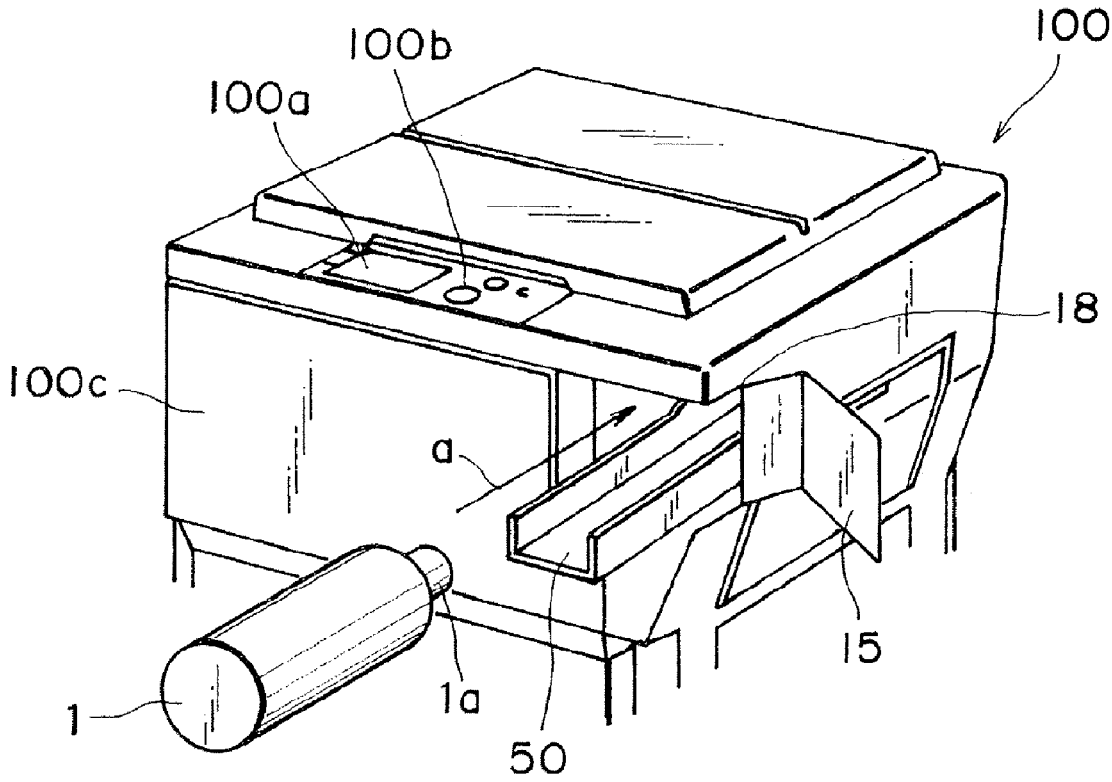
FIG. 3 is a perspective view illustrating mounting of a toner supply container into an image forming apparatus.
Figure 4:
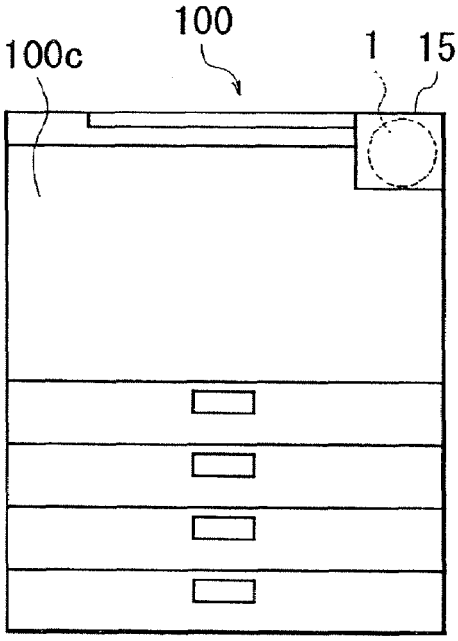
FIG. 4 is a front view of an image forming apparatus of FIG. 1.
Figure 5:
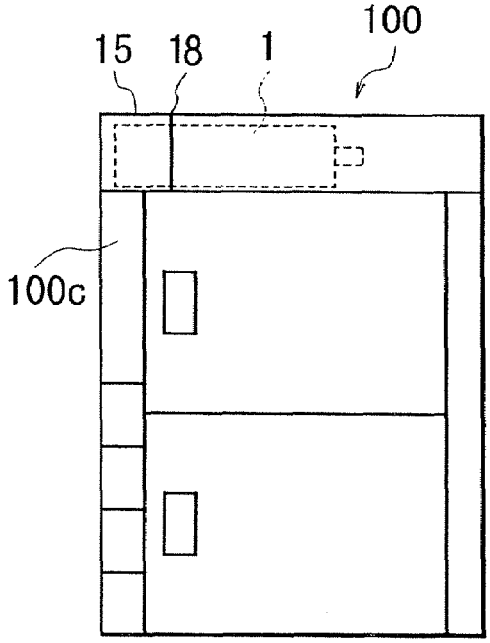
FIG. 5 is a side view of the image forming apparatus of FIG. 1.

When the user opens a front cover 15 for exchange of the toner supply container (front cover) which is a part of an outer casing shown in FIG. 2, a container receiving tray 50 which is a part of mounting means is drawn out to a predetermined position by an unshown driving system. The user places the toner supply container 1 on the container receiving tray 50. When the user takes the toner supply container 1 out of the main assembly 100 of the apparatus, the container receiving tray 15 is drawn out, and the toner supply container 1 is taken out of the tray 50.

The front cover 15 is provided exclusively for mounting and demounting (exchange) of the toner supply container 1, and therefore, it is opened and closed only for the purpose.

When the maintenance operation for the main assembly 100 of the apparatus is to be carried out, the front cover 100*c* is opened.

The toner supply container 1 may be directly mounted to the main assembly 100 of the apparatus, and may be taken out.

(Toner Supply Operation)

Figure 7:
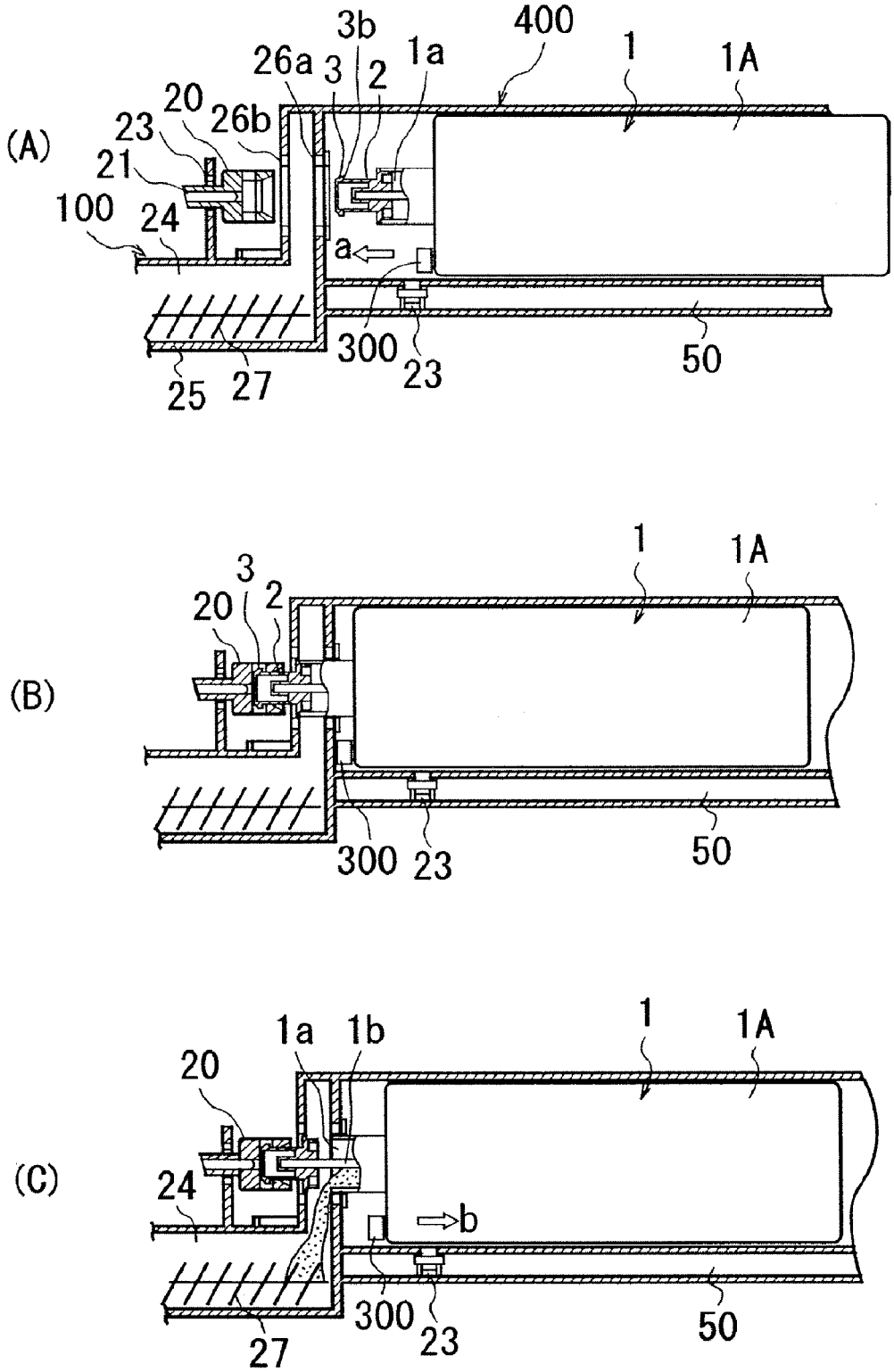
FIG. 7 is sectional views illustrating a toner supply container mounting operation, wherein (A) shows an initial stage of the mounting operation, (B) shows the state in the process of mounting operation, and (C) shows the state after the completion of the mounting operation.

Referring to FIG. 7, (A), FIG. 7, (C), the toner supply operation from the toner supply container (toner bottle) in this embodiment, will be described. FIG. 7, (A)-(C) illustrates the process of toner supply in which the toner bottle 1 of this embodiment is inserted into the main assembly 100 of the apparatus.

As shown in the Figure, the main assembly 100 of the its apparatus is provided with a toner supply device 400, and the toner supply device 400 is provided with a driving portion (driving force transmitting portion) 20 for collecting with and rotating the toner bottle 1. The driving portion 20 is rotatably supported by bearings 23, and is rotated by an unshown driving motor provided in the main assembly 100 of the apparatus.

The main assembly 100 of apparatus is further provided with a partition 25 constituting a toner supply path 24 connecting with a hopper 201*a*, and to the partition 25, inner and outer bearing 26*a*, 26*b* as for rotatably bearing a part of the toner bottle 1 and for sealing the toner supply path 24, are fixed. Furthermore, a screw member 27 is disposed in the toner supply path 24 to feed the toner to the hopper 201*a*.

FIG. 7, (A) illustrates insertion of the toner bottle 1 into the main assembly 100 of the apparatus. One end of the toner bottle 1 is provided with a toner supply opening 1*a*, which will be called simply "opening", formed by a cylindrical member in this embodiment, the opening 1*a* sealed by a sealing member 2 at the free end of the cylinder.

FIG. 7, (B) shows a state in which the toner bottle 1 has been further inserted, and an engaging projection 3 (locking projection) provided at a free end portion of the sealing member 2 is engaged with a locking hole (retaining) with the driving portion 20 provided in the main assembly. The engagement between the driving portion 20 and the sealing member 2 is accomplished in the following manner. The user inserts the toner bottle 1 into the main assembly, and by this, the driving portion 20 is brought into contact with an upper surface (locking force receiving portion) of the engaging projection. By further inserting the toner bottle 1, the driving portion 20 presses down the engaging projection to displace it. Thereafter, when the pressing action by the driving portion 20 is released, the portion supporting the locking projection restores by its own elastic force, so that engagement is accomplished.

Thus, in this embodiment, the engagement is a soul-called "snap fit" type.

Since the locking surface 3*b* (locking portion) provided in the engaging projection 3 is locked with a locking hole (portion to be locked) against a thrust direction (axial direction) motion, and therefore, as long as the locking is maintained, the sealing member 2 is retained at the fixed position by the driving portion 20, although small play is permissible.

As will be understood from FIG. 7, (C), after the sealing member 2 and the driving portion 20 are engaged, a slidable member 300 is retracted in a direction indicated by an arrow b in interrelation with a closing operation of the front cover 15 for exchange of the bottle. By this, the toner bottle 1 is retracted, too, but the sealing member is locked with the main assembly side of the image forming apparatus, and therefore, the sealing member 2 is away from the toner bottle 1, thus opening the opening 1*a* to enable toner supply.

At the time, the driving shaft 1*b* fixed to the main body 1A of the toner bottle 1, is not completely disengaged from the sealing member 2 even in the state of the opening 1*a* being sealed by the sealing member and evening the state of the opening being opened, and the engaging portion (hole portion) of the sealing member is kept engaged with the driving shaft 1*b* (portion to be engaged). The driving shaft 1*b* has a non-circular cross-sectional configuration, such as rectangular or triangular shape shape to permit driving force transmission. Correspondingly, the hole (engaging portion) has a complementary configuration for slidable fitting.

When an unshown motor is driven in this state, the rotational driving force is transmitted to a driving force receiving surface (driving force receiving portion) of the engaging projection of the sealing member 2 from the main assembly driving portion 20 (the driving portion provided in the main assembly), and the driving force is transmitted from the sealing member 2 to the driving shaft 1*b*, which rotates the toner bottle 1 to feed and discharge the toner.

Thus, the sealing member 2 has a function of sealing the opening 1*a*, a function of receiving the rotational driving force from the main assembly side of image forming apparatus, as a function of transmitting the rotational driving force to the toner bottle 1 side.

The toner bottle 1 is rotatably supported by bottle receiving roller 23 provided on a container receiving Table 50, and therefore, can be smoothly rotated by a small driving torque. The bottle receiving roller 23 is disposed at each of four positions forming a saddle with respect to the main body 1A of the bottom. The bottle receiving rollers 23 are rotatably supported on the toner supply device 400 of the main assembly 100 of the apparatus. By the rotation of the toner bottle 1, the toner accommodated in the toner bottle 1 is discharged through the opening 1*a* gradually, and the screw member 27 provided in the toner supply path 24 feeds the toner into the hopper 201*a* provided in the main assembly 100 of apparatus, thus accomplishing the toner supply.

(Exchanging Method For Toner Supply Container)

The description will be made as to an exchanging method of the toner bottle.

With the image forming operation, the toner in the toner bottle 1 is consumed. When substantially all the toner therein is used up, the "no toner" is detected by a detecting means (unshown) provided in the main assembly 100 of the apparatus, and the event is notified to the user by displaying means 100*b* (FIG. 2) such as liquid crystal display.

In this embodiment, the toner bottle 1 easy exchange by the user, through the following steps.

Figure 6:
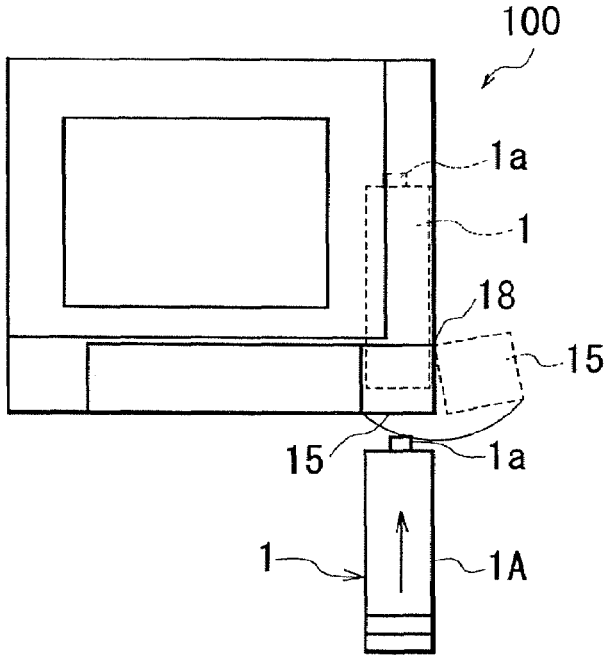
FIG. 6 is a top plan view of the image forming apparatus in which a toner container exchange cover is shown as being in an open position.

First, the front cover 15 which is in the close state is rotated about a hinge 18 to an open position indicated by broken lines in FIG. 6. In interrelation with the action of opening the front cover 15, the main body 1A of the bottle which takes the position indicated in (C) of FIG. 7 is moved in a direction indicated by an arrow an in (A) of FIG. 7 which is opposite from the direction of arrow b, by opening and closing means for the toner supplying portion which will be described hereinafter. By this, the sealing member 2 which is at an open position (away from the main body lA of the bottle to open the toner supply opening 1*a*) is press-fitted into the toner supply opening 1*a*, so that toner supply opening 1*a* is plugged (FIG. 7, (B)). At this time, the sealing member still maintains engagement with the main assembly of the image forming apparatus. Thereafter, a releasing ring applies a releasing force to a releasing projection, by which the releasing projection is depressed together with the engaging projection, so that engagement is released. By retracting the main body 1A of the bottle in a longitudinal direction of the bottle, the releasing operation between the sealing member and the main assembly of the image forming apparatus is completed.

Then, the user draws the vacant toner bottle 1 which has been released from the main assembly 100 of the apparatus out of the main assembly 100 of the apparatus in the direction of arrow b (FIG. 7 (C)) which is opposite from the direction of arrow a (FIG. 7 (A) arrow a).

The user then inserts a new toner bottle 1 into the main assembly 100 of the apparatus in the direction of arrow a, and then close the front cover 15. In interrelation with the front cover 15 closing action, the sealing member 2 locked with the main assembly of the image forming apparatus is moved away from the main body of the container by the toner supplying portion opening and closing means, so that toner supply opening 1*a* is unsealed (FIG. 7, (C)). The foregoing is the exchanging process of the toner supply container.

(Toner Bottle)

Figure 8:
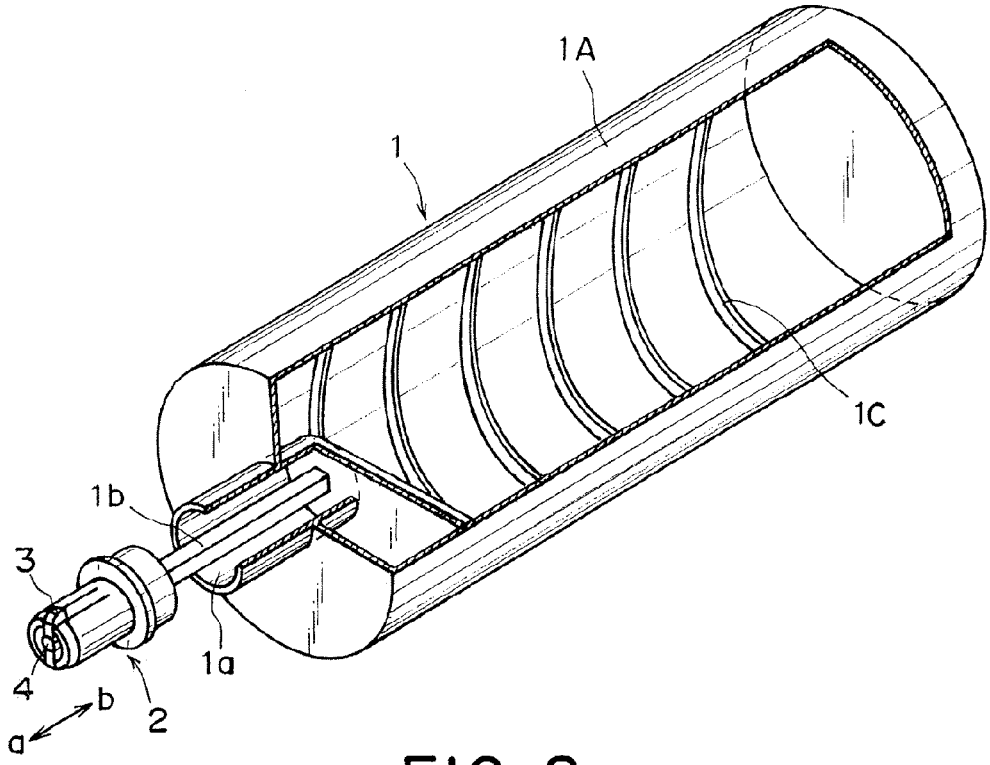
FIG. 8 is a partly broken perspective view of a toner supply container according to an embodiment of the present invention.
Figure 9:
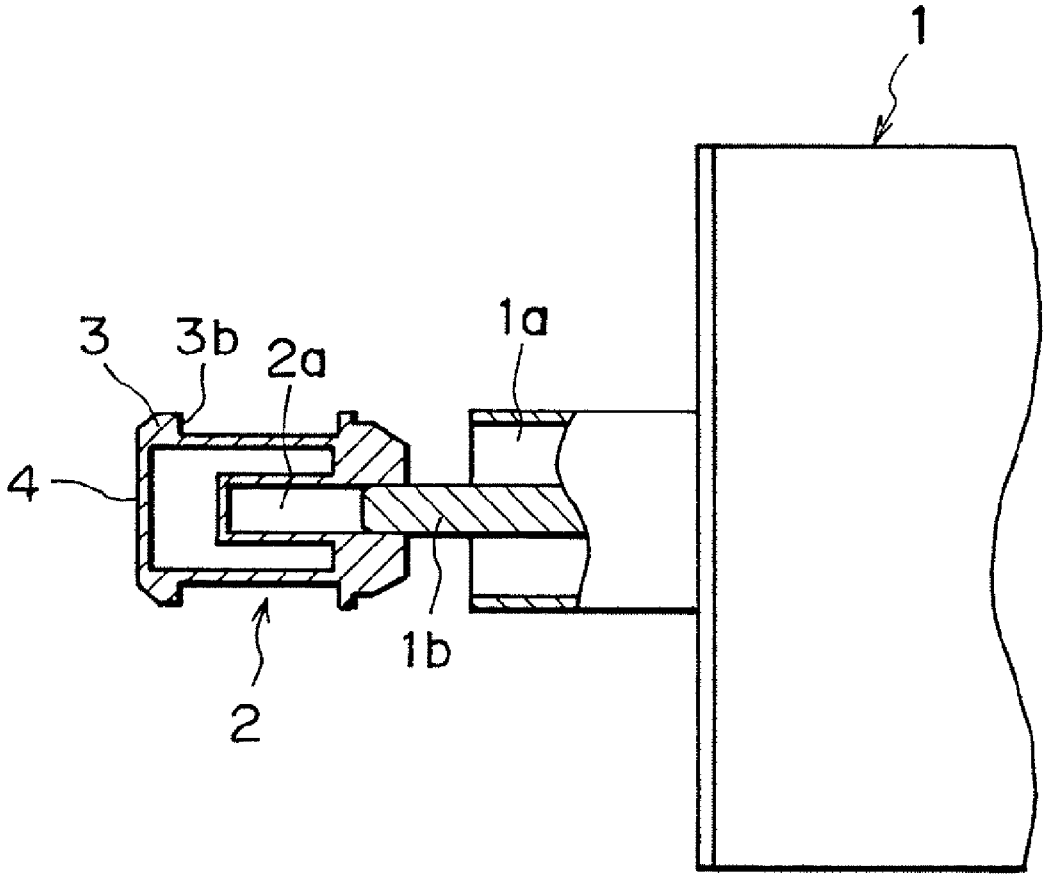
FIG. 9 is a partly enlarged section of view of a drive transmitting portion according to an embodiment of the present invention in which a driving shaft is provided on the main body side of the toner supply container.

Referring to FIG. 8 and FIG. 9, the toner bottle will be described.

The toner bottle 1 is generally cylindrical, and one end thereof is provided substantially at a center with an opening 1*a* by a projected portion. The diameter of the opening 1*a* is smaller than the diameter of the cylindrical portion 1A which is the main body of the bottle. The opening 1*a* is plugged with a sealing member 2 for sealing the opening 1*a*, and as will be understood from the description in conjunction with FIG. 7, (A)-(C), the opening 1*a* is unsealed and resealed automatically by the sliding motion of the sealing member 2 relative to the toner bottle 1 in the longitudinal direction (arrow b) of the toner bottle 1.

At the free end portion of the sealing member 2, there is formed a cylindrical portion having an engaging projection 3 and a releasing force receiving portion 4 for disengaging from the driving portion 20 provided in the main assembly of apparatus, and such a portion of the cylindrical portion as supports the engaging projection and the releasing projection is elastically deformable (in order to enhance or assist the elastic information, slits are formed at lateral sides of the region so as to extend to the free end of the cylindrical portion, as will be described hereinafter).

The engaging projection 3 is engaged with the driving portion 20 and functions to transmit the rotation to the toner bottle 1. The structures of the engaging projection 3 and the releasing force will be described in detail hereinafter.

The internal structure of the toner bottle 1 will be described.

As described in the foregoing, the toner bottle 1 is generally cylindrical in shape and is disposed generally horizontally in the main assembly 100 of apparatus. It is rotated by the main assembly 100 of apparatus. An inside of the toner bottle 1 has a projection 1*c* in the form of a rib which extends helically. When the toner bottle 1 rotates, the toner is fed in the axial direction along the helical projection 1*c*, and the toner is discharged through the opening 1*a* formed at an end of the toner bottle 1.

The internal structure of the toner bottle 1 according to the present invention is not limiting, and the configuration or the structure may be any as long as the toner can be discharged by rotation of the toner bottle 1. The main body of the toner bottle is not limited to that described in the foregoing. For example, it may have a rotation screw or the like for feeding the toner, and the rotation screw is driven by a rotational driving force received by the sealing member from the image forming apparatus, while the main body is fixed (not rotatable) on the main assembly of the image forming apparatus.

The feature this embodiment is in the structure of the drive transmitting portion for connection with the main assembly 100 of the apparatus, and therefore, the internal structure of the toner bottle 1 may be any, and the bottle may have a helical projection 1*c* on the inner surface of the bottle.

Figure 10:
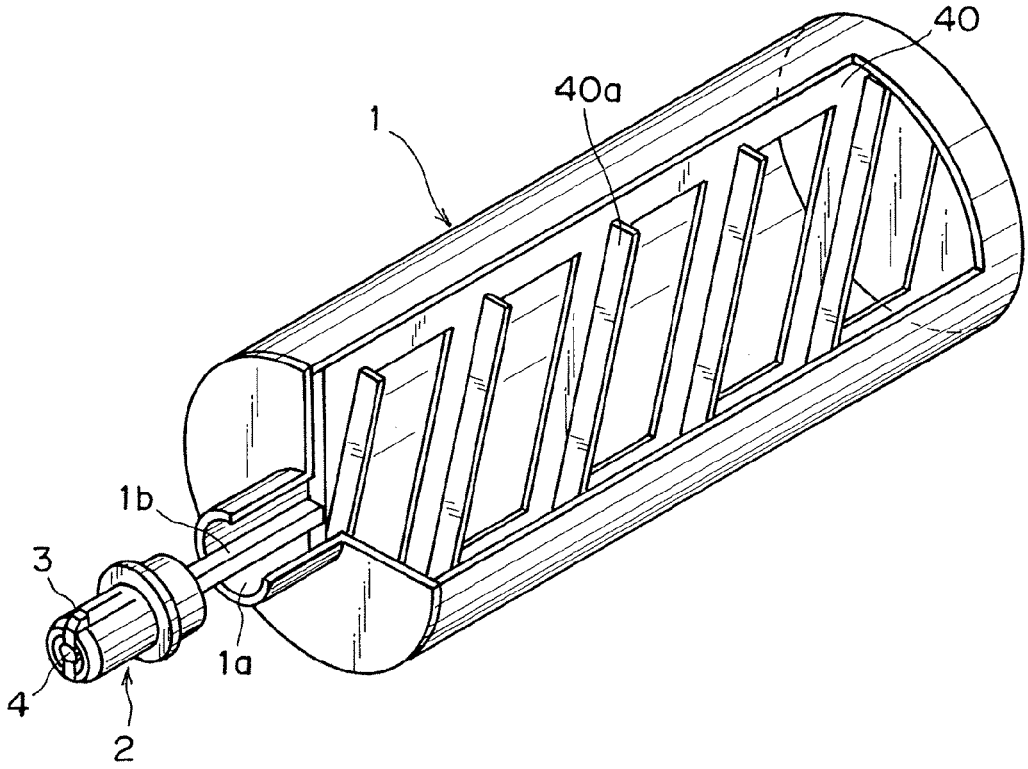
FIG. 10 is a partly broken perspective view of a toner supply container according to another embodiment of the present invention.

For example, the internal structure of the bottle may be modified as shown in FIG. 10. In this modified example, there is provided in the main body of the bottle is buffle member 40 generally in the form of a plate. The surface of the buffle member 40 has, on a surface, a plurality of inclined projections 40*a* which are inclined with respect to the direction of the axis of the toner bottle 1. One end of one of the inclined projection 40*a* extends to a neighborhood of the opening 1*a*. The toner is finally discharged from the inclined projection 40*a* through the opening 1*a*. By the rotation of the toner bottle 1, the toner is scooped by the buffle member 40 and then falls sliding on the surface of the buffle member 40. Because of the inclination of the inclined projection 40*a*, the toner is advanced toward the front side of the toner bottle 1. By repeating this operation, the toner in the toner bottle is gradually fed to the opening 1*a* while being stirred, and is discharged therethrough.

The driving type of this invention is not limited to the rotational driving type such as the type of this embodiment or modification. The toner bottle may be vibrated, swung or may be moved in another fashion to supply the toner. In other words, the driving may be rotation, swing, vibration or another as long as the toner is discharged from the bottle by the toner bottle is moved by the main assembly 100 of apparatus.

In the above-described modified example, the buffle member 40 in the form of the plate is a separate member from the toner bottle 1, and the rotational driving force is transmitted to the buffle member 40 through the sealing member 2 to indirectly rotate the toner bottle 1.

In the manner, the present invention is applicable when the toner bottle 1 is directly or indirectly driven through a sealing member 2.

In FIGS. 8 and 9, the main body 1A of the bottle is provided with the opening 1*a* at the one longitudinal end surface thereof, and a driving shaft 1*b* (portion to be engaged) is projected out of the opening 1*a*, the driving shaft 1*b* being integral with the main body 1A of the bottle and being provided in the opening 1*a*. The driving shaft 1*b* is disposed substantially coaxially with the opening 1*a*, and is slidably engaged with an engaging hole 2*a* (engaging portion) formed in the sealing member 2. The engaging hole, as shown in FIG. 9, is closed at an end remote from the driving shaft, so that toner leakage through the engaging hole is prevented.

The driving shaft 1*b* functions to transmit the rotational driving force from the main assembly 100 of the apparatus to the main body 1A of the bottle through the sealing member 2, the cross-sectional configuration of the driving shaft 1*b* is non-circular, for example, rectangular configuration, H shape, D shape or the like to transmit the rotational driving force. The driving shaft 1*b* is fixed on the main body 1A of the bottle by proper means.

Figure 11:
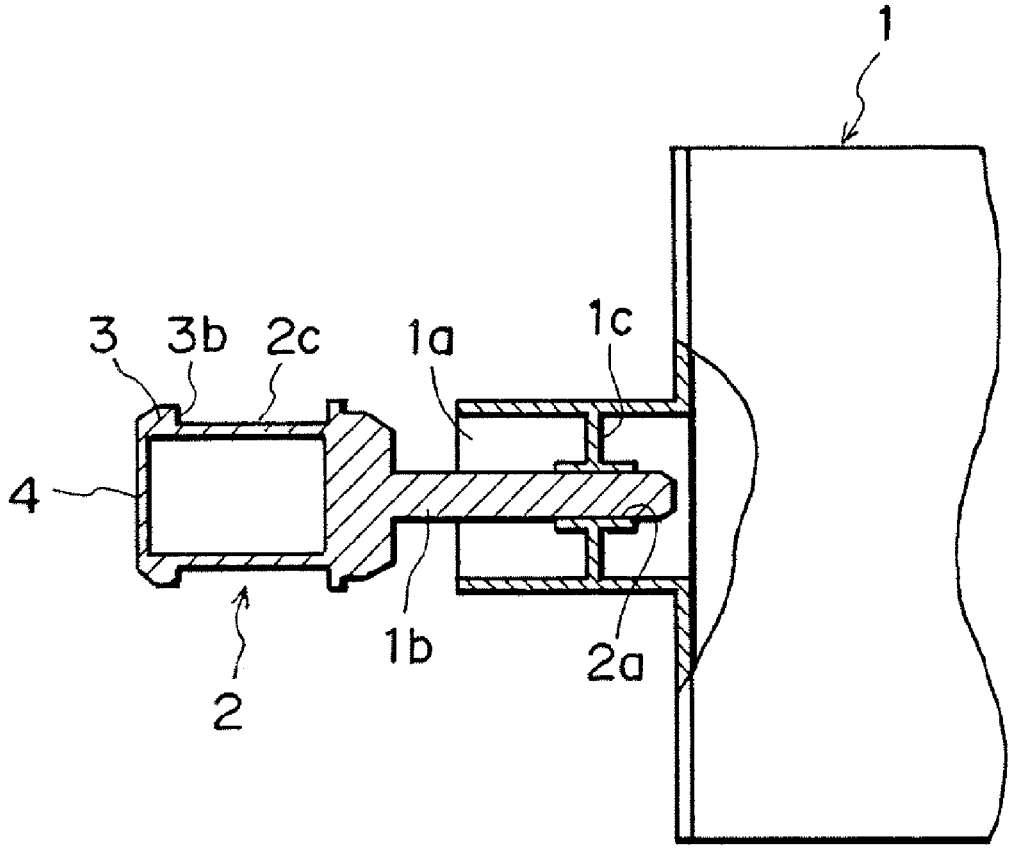
FIG. 11 is a partly enlarged section of view of a drive transmitting portion according to another embodiment of the present invention in which a driving shaft is provided on a sealing member side.

The driving shaft 1*b* may not be fixed on the main body 1A of the bottle but is integral with the sealing member 2 as shown in FIG. 11. In this case, the engaging hole 2*a* for transmitting the driving force from the driving shaft 1*b* is provided in the toner bottle 1 side, and that opening is formed so that they are its maintained engaged with each other after the toner bottle is unsealed. In the modified example, the member defining the engaging hole 2*a* its supported by a member 1*c* provided inside the opening 1*a*, but the discharge of the toner is permitted.

In this embodiment, the driving shaft 1*b* is fixed on the main body 1A of the bottle.

(Sealing Member)

Figure 12:
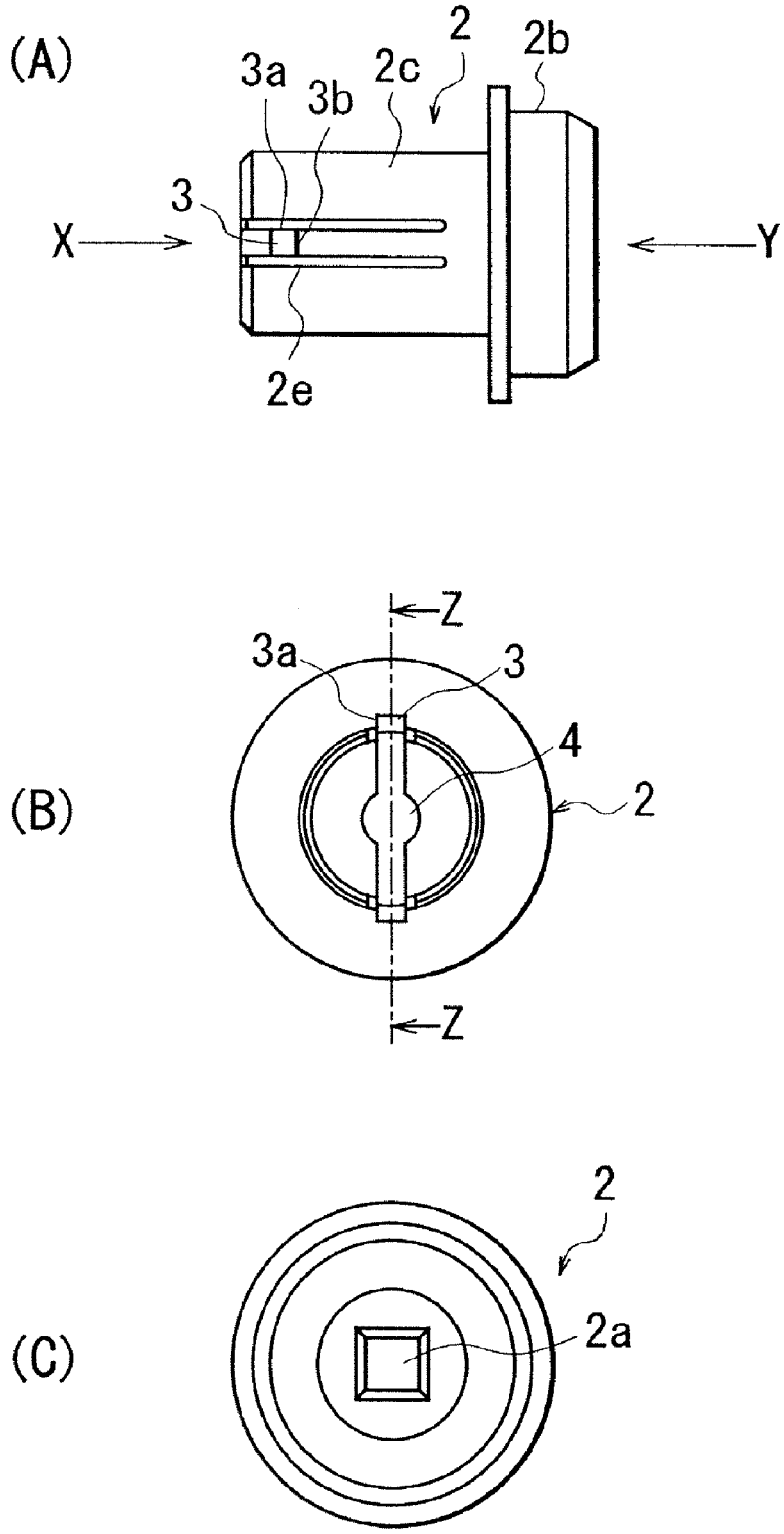
FIG. 12 is a side view of a sealing member according to an embodiment of the present invention, wherein (A) is a front view, (B) is a side view as seen in the direction X of (A), and (C) is a side view as seen in the direction Y of (A).
Figure 13:
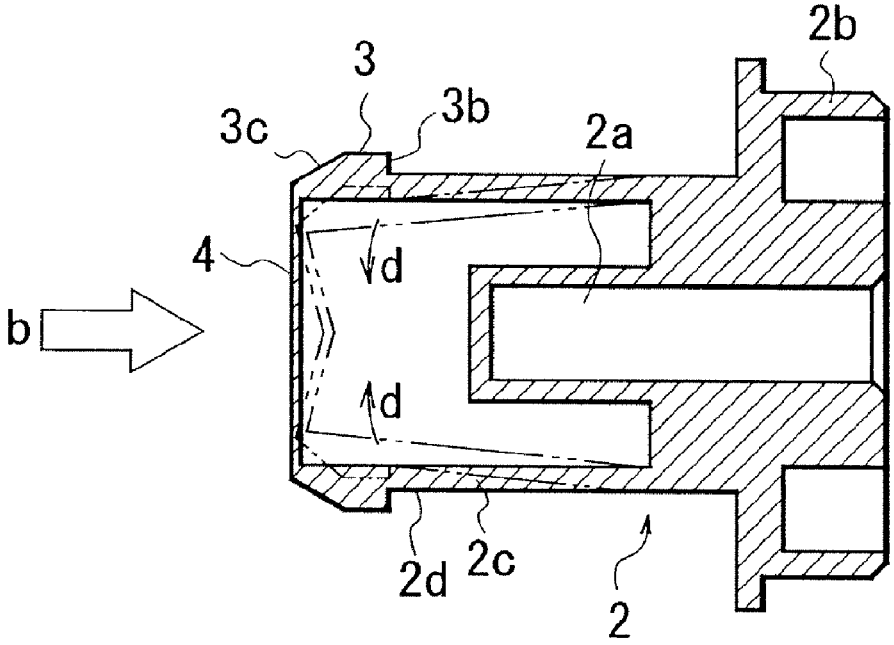
FIG. 13 is a sectional view of a sealing member taken along a line X-X of (B) of FIG. 12.

Referring to FIGS. 12 and 13, the description will be made as to the sealing member 2 (drive receiving member).

In FIGS. 12 and 13, the sealing member 2 comprises a sealing portion 2*b* for unsealably sealing the opening 1*a* of the toner bottle 1, and a coupling engagement portion 2*c* (cylindrical portion) in the form of a cylinder engageable with the driving portion 20 of the main assembly of apparatus. An outer diameter of a large diameter portion of the sealing portion 2*b* is larger than the inner diameter of the opening 1*a* by a proper degree. The sealing portion 2*b* is press-fitted into the opening 1*a*, by which the opening 1*a* (toner supply opening) is sealed by the sealing member 2.

As described in the foregoing, the sealing member 2 has an engaging hole 2*a* for transmitting the driving force received from the main assembly 100 of the apparatus to the driving shaft 1*b* by engagement with the driving shaft 1*b*. The engaging hole 2*a* extended continuously in the sealing portion 2*b* and the engaging portion 2*c*. The engaging hole 2*a* has a cross-sectional configuration which is complementary with the driving shaft 1*b* and which is slightly larger than the cross-section of the driving shaft 1*b*. Because of this, the driving shaft 1*b* is loosely fitted in the engaging hole 2*a*. The engaging hole 2*a* and the driving shaft 1*b* have complementary polygonal configurations. In this embodiment, it is square.

Because of the loose fitting of the driving shaft 1*b* in the engaging hole 2*a* having such cross-sections, the main body 1A of the bottle and the sealing member 2 are slidable relative to each other in the axial direction while being prevented from relative rotational motion therebetween. With this structure, when the toner bottle 1 is mounted (locked) on the toner supply device 400, the sealing member 2 is movable relative to the main body 1A of the bottle, that is, the unsealing of the opening 1*a* (toner supply opening) is enabled.

The engagement length between the engaging hole 2*a* and the driving shaft 1*b* is determined such that they are not this engaged from each other upon the relative movement between the sealing member 2 and the main body 1A of the bottle for the unsealing. By doing so, the driving shaft 1*b* can receive the driving force through the sealing member 2 even if the sealing member 2 is moved away relatively from the main body 1.

The description will be made as to the engaging projection 3 (locking projection) which is one of the features of the present invention.

The coupling engagement portion 2*c* of the sealing member 2 has an engaging projection 3 for receiving the driving force from the main assembly 100 of apparatus. The engaging projection 3 is projected radially outwardly from the peripheral surface of the cylindrical portion of the coupling engagement portion 2*c*. The engaging projection comprises a drive receiving surface 3*a* (driving force receiving portion) for receiving the rotational driving force from the main assembly of the apparatus; and a locking surface 3*b* (locking portion) for snap fit type locking of the sealing member 2 into a locking hole (portion to be locked) provided in the main assembly of apparatus when the sealing member 2 and the toner bottle 1 are moved away from each other (from the closed state to the open state). Thus, by the drive receiving surface 3*a*, the engaging hole 2*a* and the locking surface 3*b*, the engaging projection 3 performs three different functions, namely, a coupling function for receiving the rotational driving force from the main assembly of apparatus, a transmitting function of transmitting the rotation to the toner bottle 1, and a locking function (retention function) for permitting relative sliding motion between the sealing member 2 and the main body of the toner bottle 1 so as to automatically open and close the opening.

When the driving force is transmitted with the locking surface 3*b* locked with the main assembly driving portion 20, the surface 3*b* is effective to maintain a constant distances between the sealing member 2 and the toner bottle 1. This assures the formation of the path of the toner between the toner bottle 1 and the sealing member 2, so that toner discharging amount is maintained constant. Thus, a toner bottle having an excellent constant amount discharging property can be accomplished. In addition, the sealing member 2 is assuredly locked with the main assembly driving portion 20 of the apparatus, and therefore, the sealing member 2 is not likely to disengage from the driving shaft during the toner discharging operation, thus further assuring the toner discharging.

According to such a structure, the automatic opening and closing operation of the sealing member 2 and the driving force transmitting operation can be accomplished by a single sealing member, so that inexpensive and compact toner supply container can be provided.

The engaging projection 3 is preferably in general with the sealing member 2 from this standpoint of reduction of the number of constituent parts, but a separate member for the engaging projection 3 may be mounted to the sealing member 2. Such an example will be described in conjunction with a fourth embodiment.

The engaging projection 3 has a driving force receiving function as well as the locking function, and therefore, it has a certain degree of rigidity. In view of this, slits 2*e* or the like are formed at lateral ends of the engaging projection 3, so that only the part of the coupling engagement portion 2*c* where the engaging projection 3 is provided, can relatively freely deformable elastically toward the inside. This is because the engaging projection 3 is displaced by the main assembly 100 of apparatus to effect the engagement and disengagement relative to the main assembly of apparatus, as will be described hereinafter.

In this embodiment, the engaging projection 3 is integral with the sealing member 2 in this embodiment.

The free end portion of the engaging projection 3 is provided with a taper (locking force receiving portion) so as to permit smooth insertion when the sealing member 2 is inserted into the driving portion 20 of the main assembly 100 of apparatus. The tapered surface 3*c* receives a locking force from an inner surface of the driving portion 20 so that engaging projection 3 (locking portion) is displaced inwardly to lock into the locking hole when the tapered surface 3*c* approaches relatively to the locking hole 20*h* of the driving portion 20. When the locking surface further approaches to the locking hole to such an extent that contact of the tapered portion 3*c* to the inner surface of the driving portion 20, that is, the locking force is released, the portion supporting the engaging projection (locking portion) restores from the displaced position, thus completing the locking between the sealing member (locking portion) and the main assembly (portion to be locked) of the image forming apparatus.

After the completion of the locking action, the relative motion between the sealing member and the main body of the bottle is automatically imparted in the direction away from each other, by which the opening is unsealed to enable the toner discharge. In this embodiment, the sealing member is engaged with the main assembly of apparatus such that movement in the sliding direction is prevented, and in this state, the main body of the bottle is retracted or advanced to automatically open or close the opening.

In addition, the coupling engaging portion 2*c* functions to minimize the formation of the engaging projection 3 when the rotational driving force is imparted to the engaging projection 3.

Figure 34A:
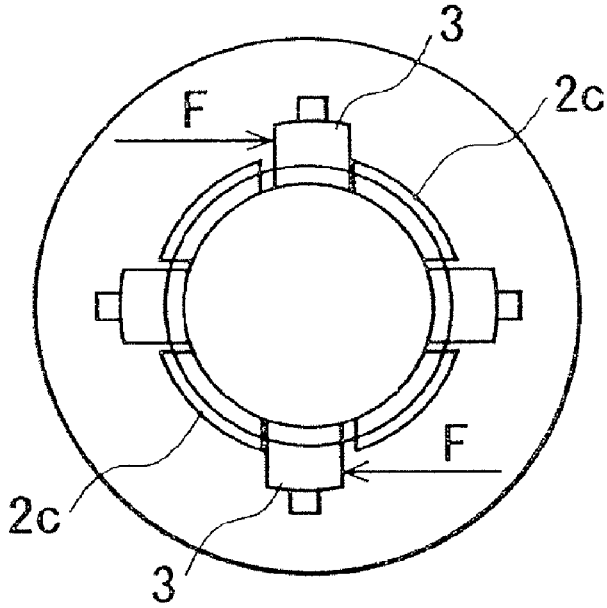
FIG. 34 schematically shows the sealing member which is rotating.
Figure 34B:
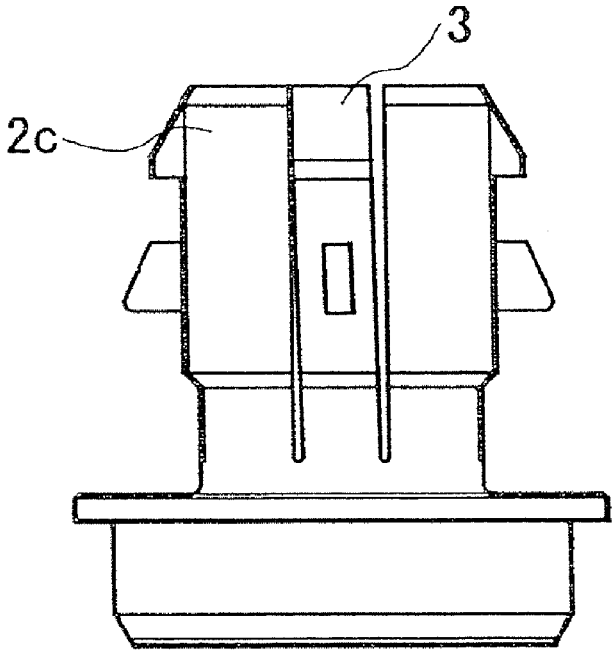

As shown in FIG. 34, (A), when the in driving force F is imparted to the engaging projection 3, the engaging projection elastically deforms as shown in (A) and (B). However, it abuts the coupling engaging portion 2*c*, so that a further the formation is prevented. Therefore, even when a large rotational driving force is imparted, the engaging projection 3 does not deform beyond the width of the slot because of the provision of the coupling engaging portion 2*c*. Therefore, the structure is enough for use with a large capacity toner bottle. The amount of the formation of the engaging projection 3 is dependent on the width of the groove 2*e*, and therefore, the width of the groove 2*e* is preferably as small as possible.

Referring to FIGS. 12 and 13, the description will be made as to the structure of a releasing force receiving portion which is another one of the features of the present invention.

The engaging projection 3 described above is provided at each of two positions which are diametrically opposed to each other, and the two engaging projections 3 are connected by a connecting portion which functions as a releasing force receiving portion 4. When the releasing force receiving portion (releasing portion) 4 receives a force from the main assembly old apparatus in the direction indicated by an arrow b, the engaging projections 3 are elastically deformed as indicated by chain lines in FIG. 13. If the force application is stopped, the original position is restored. The releasing portion 4 has a relatively small thickness to permit the elastic deformation, and the material is selected in consideration of such an elastic deformation.

It is preferable that sealing member 2 is manufactured through an injection molding from a plastic resin material or the like, but another material, or another manufacturing method is usable. They may be provided by connecting separate members. The sealing member 2 desirably has a proper elasticity since it is press-fitted into the opening 1*a* to seal it. The best material is low density polyethylene material, and preferable materials are polypropylene, normal chain polyamide, Nylon (tradename), high density polyethylene, polyester, ABS, HIPS (shock-resistant polystyrene) or the like.

By employing an elastically deformable elastic member for the parts supporting the engaging projection 3 and for the releasing portion 4, the locking and releasing between the driving portion 20 and the engaging projection 3 can be accomplished with a simple structure, utilizing the elastic deformation and restoration. The above-described materials have proper elasticities, and therefore, the engagement and disengagement of the driving portion 20 and the engaging projection 3 are easily effected with sufficient durability.

The releasing portion 4 is in the form of a bridge connecting the engaging projections 3, so that such a plurality of engaging projections 3 can be uniformly displaced by pushing one releasing portion.

Figure 16:
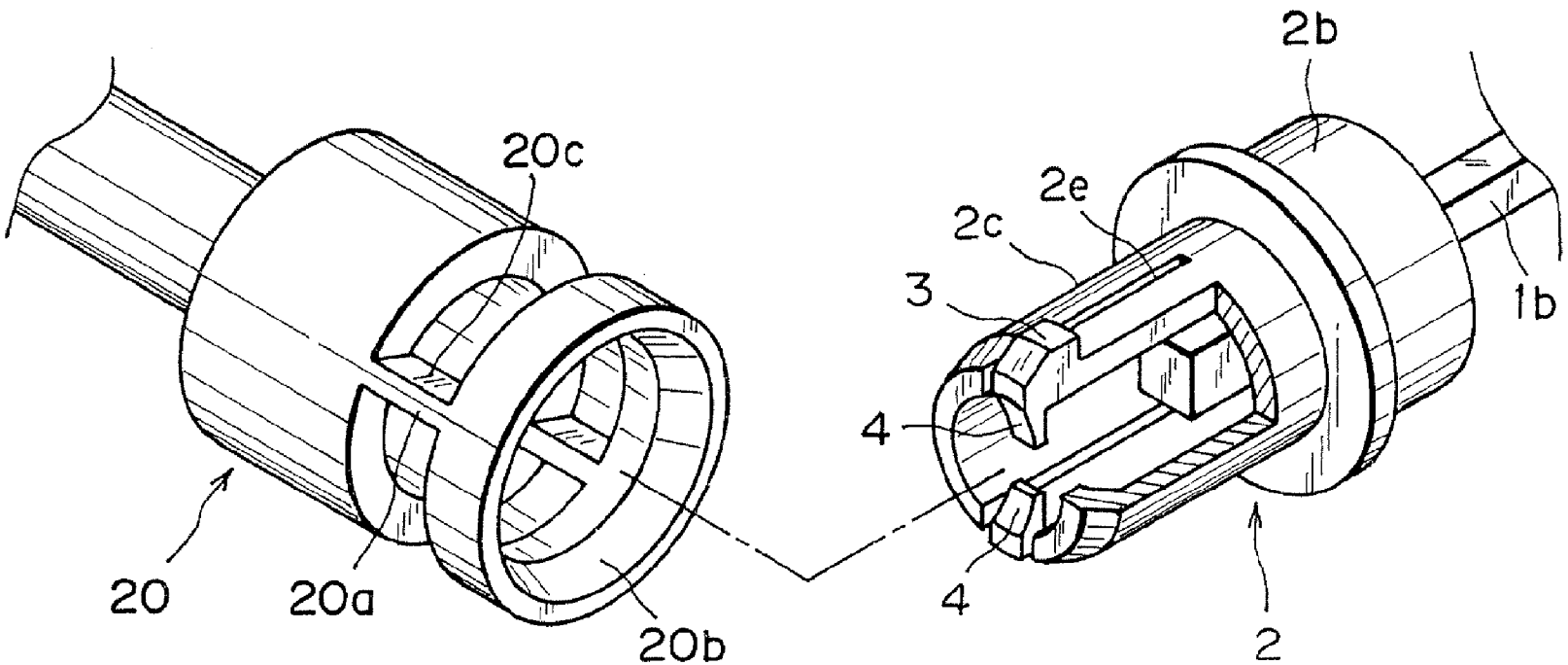
FIG. 16 is a perspective view of a driving force receiving portion according to another embodiment of the present invention.
Figure 17:
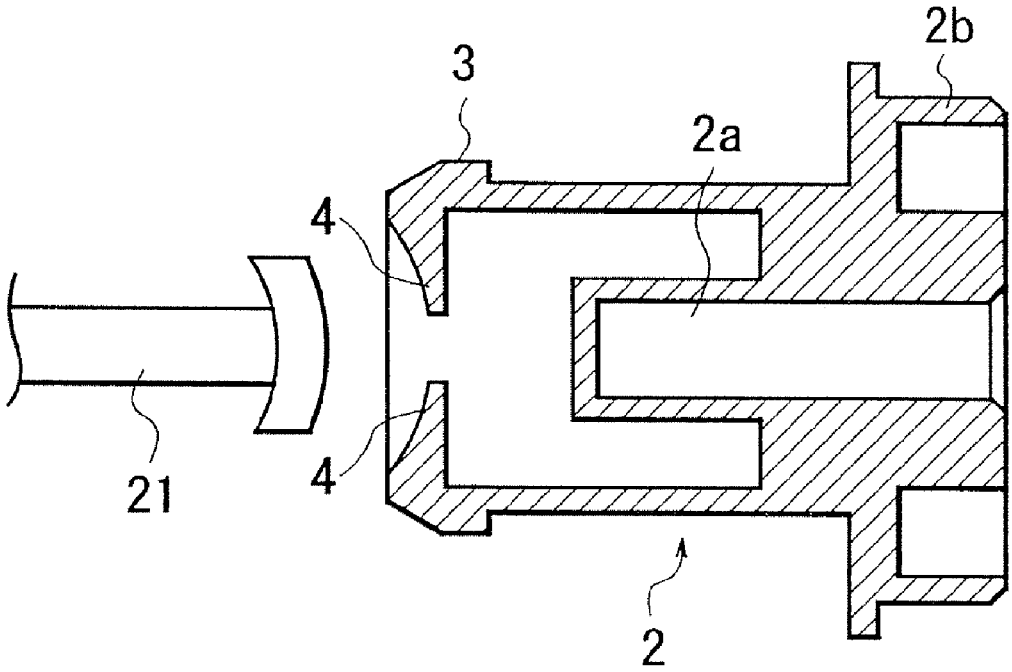
FIG. 17 is a sectional view of the sealing member of FIG. 16.

It is not inevitable to integrally connect the engaging projections, but releasing portions may be provided for the respective engaging projections, as shown in FIGS. 16 and 17.

(Driving Force Receiving Portion)

Figure 14:
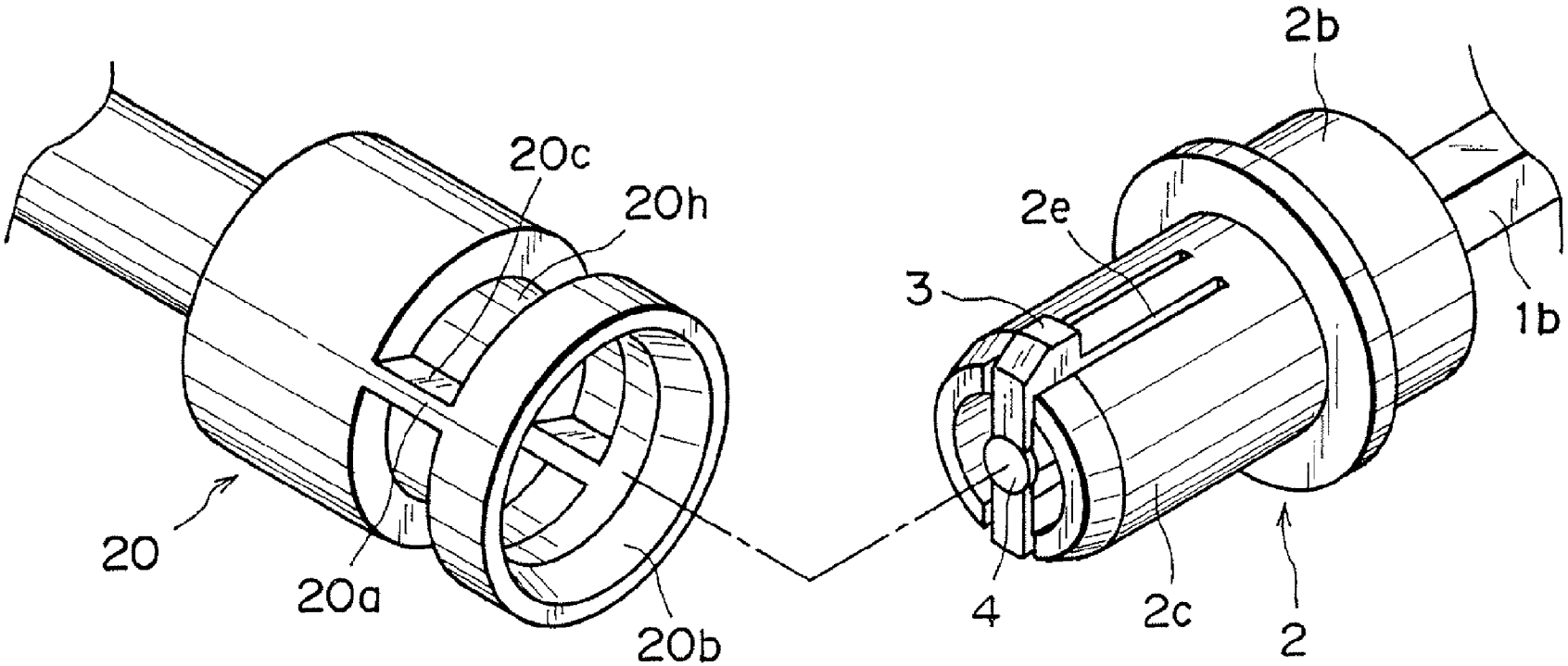
FIG. 14 is a perspective view of a driving force transmitting portion and a driving force receiving portion according to an embodiment of the present invention.

Referring to FIG. 14, the description will be made as to the structure of the coupling engagement portion 2*c* provided in the sealing member 2, which is another one of the features of the present invention.

In this embodiment, the sealing member 2 is provided with the coupling engagement portion 2*c* in the form of a cylinder. As described in the foregoing, it also functions as a drive receiving member to receive the driving force from the driving force transmitting portion 20 provided in the toner supply device 400.

In the cylindrical coupling engagement portion 2*c* of the sealing member 2, the two parts provided with the respective engaging projections 3 are elastically deformable, such that parts are easily and elastically deformed by the tapered portion 3*c* of the engaging projection 3 being pressed by the driving portion 20. The releasing portion 4 is provided so as to connect the engaging projections 3, and the engaging projection 3 and the releasing portion 4 are integral with each other.

On the other hand, the locking hole 20*h* of the driving portion 20 provided in the main assembly 100 side of the apparatus is constructed so as to be locked with the engaging projection 3 (locking surface) of the sealing member 2. When the sealing member 2 is inserted into the driving portion 20, the smooth insertion is accomplished by providing the driving portion 20 with a tapered surface 20*b* defining gradually decreasing inner diameter at the free end of the driving portion 20. The sealing member 2 is smoothly inserted into the driving portion 20 because of the provision of the tapered surface 20*b*.

The driving portion 20 is provided with an engaging rib 20*a* for rotating the toner bottle 1, and the engaging rib 20*a* abuts the drive receiving surface 3*a* to transmit the rotational driving force to the sealing member after the engaging projection is engaged with the locking hole 20*h*.

Figure 15:
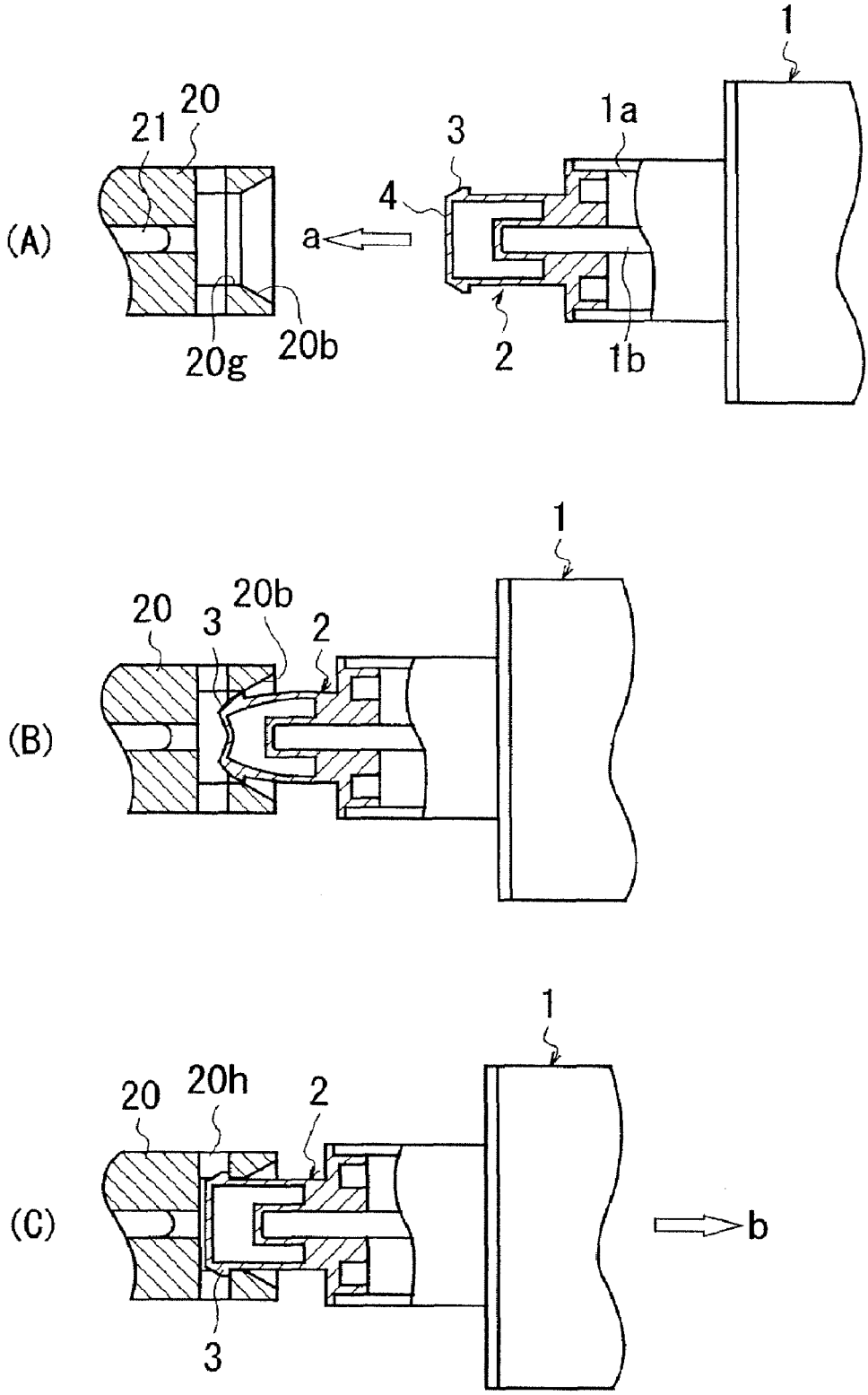
FIG. 15 is a partially sectional view illustrating engaging action of a drive transmitting portion of a toner bottle, in which (A) shows a state before insertion of toner bottle, (B) shows a state in the process of insertion, (C) shows a state after the completion of inserting operation.

Referring to FIG. 15, the engagement between the driving portion 20 and the sealing member 2 in this embodiment will be described.

In FIG. 15, (A) shows a state when the user is setting a new toner bottle 1 in the direction indicated by an arrow an in order to install it into the main assembly 100 of the apparatus, in which the toner bottle 1 is not yet been engaged with the driving portion 20 in the main assembly of apparatus.

When the toner bottle 1 is further inserted, the tapered portion 3*c* of the engaging projection 3 of the sealing member 2 is brought into contact with the tapered surface 20*b* of the driving portion 20, as shown in (B) in FIG. 15, and the engaging projection 3 is being guided by the tapered surface 20*b* while being elastically deformed toward inside.

With the further insertion of the toner bottle 1, the engaging projection 3 passes by the straight portion 20*g* containing from the tapered surface 20*b*, the engaging projection 3 restores because of the provision of the space portion 20*h* (locking hole) not having the engaging rib 20*a*, by which the engaging projection 3 is locked with the driving portion 20, as shown in (C) in FIG. 15. In the state, the engaging projection 3 is firmly locked relative to the driving portion 20, and the position of the sealing member 2 in the thrust direction (axial direction) is substantially fixed relative to the main assembly of apparatus.

Therefore, even if the toner bottle 1 is retracted in the direction indicated by an arrow arrow b, as shown in (C) in FIG. 7, the sealing member 2 does not move in the same direction, but is firmly fixed to the driving portion 20. On the other hand, since the toner bottle 1 is instructed, the sealing member 2 is separated away from the toner bottle 1 with certainty, so that opening 1*a* is unsealed or opened. The sliding retracting operation of the toner bottle 1 may be interrelated with the opening and closing operation of the front cover 15 provided in the main assembly 100 of the apparatus.

As for the sliding operation, the toner bottle 1 may be slid with the sealing member 2 fixed, or the sealing member 2 may be slid with the toner bottle 1 fixed, or both of them may be slid away from each other.

When the toner is used up from the toner bottle, the empty toner bottle is taken out to exchange it with a new toner bottle. The dismounting operation is carried out by the above-described steps in a reverse order.

In detail, when the operator opens the front cover, the following occurs. First, the main body of the toner bottle advances toward the sealing member while the sealing member is locked in the main assembly of the apparatus, by which the sealing member of the opening is automatically sealed. By a pushing member 21 which will be described hereinafter, a releasing projection is actuated to release the engaging projection from the locking hole. Then, the main body of the toner bottle is retracted together with the sealing member re-press-fitted into the opening, so that sealing member is disengaged from the main assembly of the apparatus. By this, the toner bottle is prepared for being removed from the main assembly of the apparatus.

(Structure Eliminating Necessity of Phase Alignment)

The description will be made as to the structure eliminating the necessity of phase alignment when the toner bottle 1 is brought into engagement with the main assembly driving portion 20.

Figure 18:
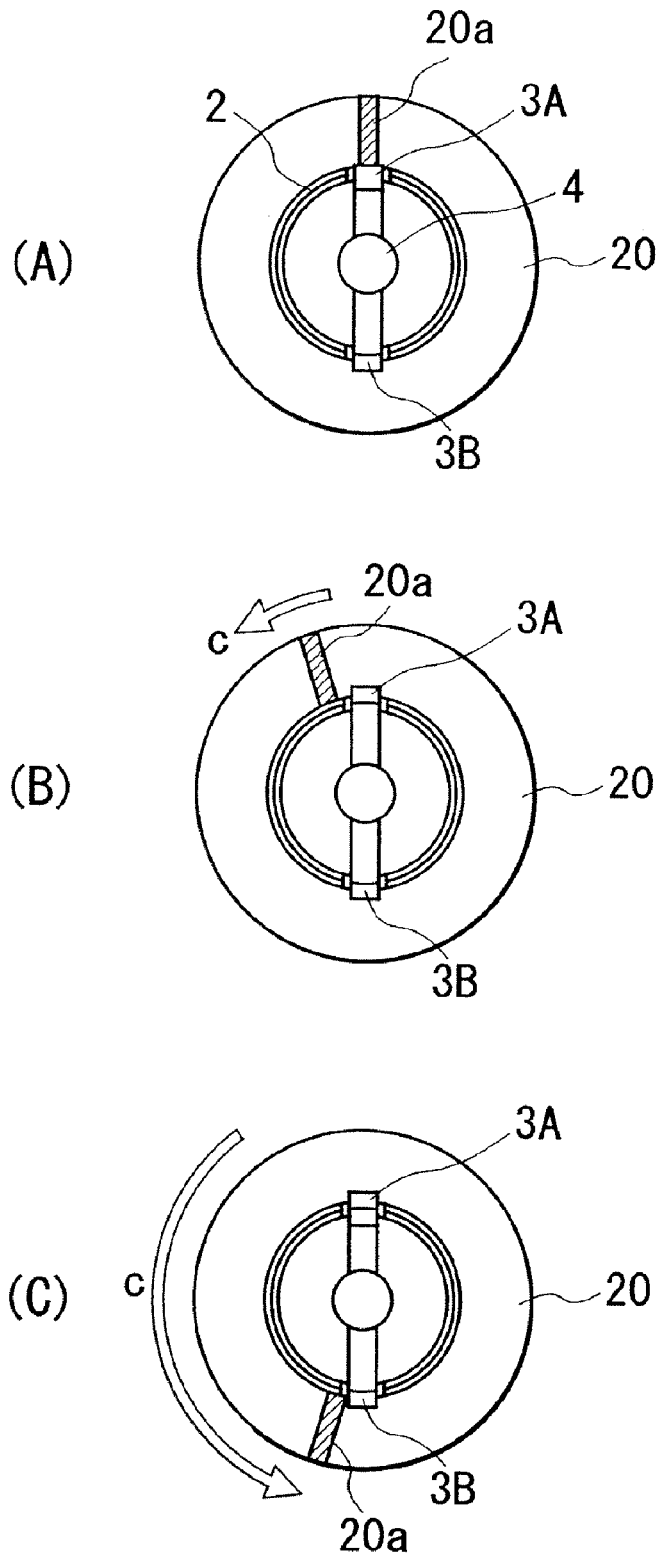
FIG. 18 is an illustration of phase alignment when the toner bottle is inserted into the main assembly of apparatus wherein (A) shows a state in which an engaging rib and an engaging projection are aligned with each other, (B) shows a state in which they are not aligned after rotation to a certain extent, and (C) shows a state in which the engaging rib is abutted to the engaging projection to enable drive transmission.
Figure 19:
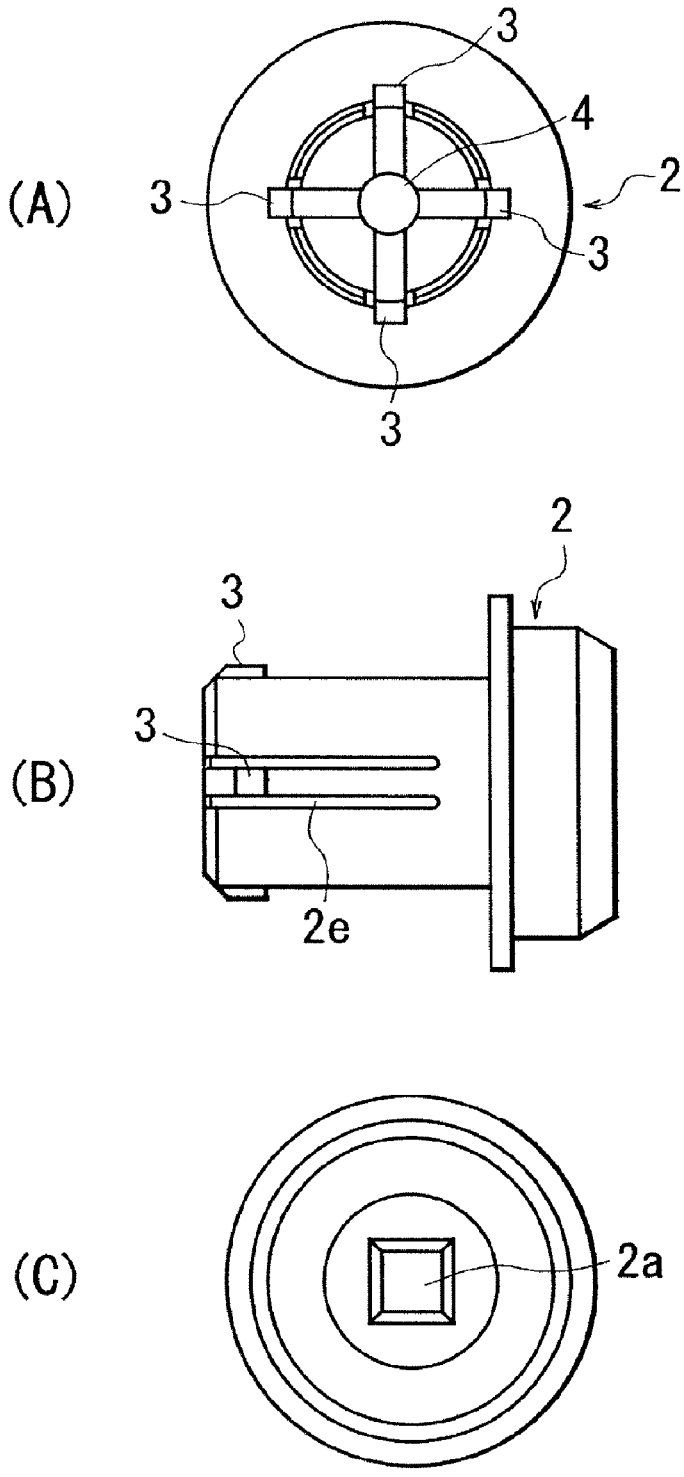
FIG. 19 shows a sealing member according to an embodiment of the present invention, wherein (A) is a left side view, (B) is a front view, and (C) is a right-hand side view.

In a conventional drive transmitting means using a combination of projection and recesses type coupling drive, it is necessary to engage a recess and a projection with phase alignment. This is not necessary according to this embodiment. Referring to FIG. 18, this will be described.

FIG. 18 shows a positional relation in the rotational direction between the engaging projection 3 and the engaging rib 20*a* when the sealing member 2 is inserted into the driving portion 20. The engaging rib 20*a* is provided at one position, and the engaging projection 3 is provided at two positions (3A, 3B).

Assuming that engaging rib 20*a* and the engaging projection 3 are not aligned with each other when the user inserts the toner bottle 1, when the toner bottle 1 is inserted into the predetermined position, the sealing member 2 is locked with the driving portion 20, and when the toner bottle 1 is retracted, the sealing member 2 is away from the toner bottle 1 to establish the toner dischargeable state.

However, depending on the position in the rotational direction of the toner bottle 1 upon the insertion of the toner bottle, the engaging projection 3A is aligned with the engaging rib 20*a* as shown in (A) of FIG. 18. In this case, even if the toner bottle 1 is inserted into the predetermined position, the engaging projection 3A interfere with the engaging rib 20*a* so that it is not released outwardly. Then, the locking is incomplete. If the toner bottle 1 is retracted with the state, the toner bottle 1 is retracted together with the sealing member 2 since the locking with the main assembly driving portion 20 is incomplete. The opening 1*a* cannot be unsealed or opened.

In order to avoid this, the number of engaging projections 3 is larger than that of the engaging ribs 20*a* by at least one, by which not all of the engaging rib (s) and engaging projection (s) are aligned.

In the case of (A) of FIG. 18, one of the engaging projections 3A interferes with the engaging rib 20*a*, and therefore, is not locked with the main assembly driving portion 20. However, the other one of the engaging projections 3B does not interfere with the engaging rib 20*a*, and therefore, it is correctly locked with the driving portion 20. Thus, even if one of the engaging projections 3A is not locked correctly, the other engaging projection 3B is correctly locked, and therefore, the toner bottle 1 is separated away from the sealing member 2 without problem, so that opening 1*a* is unsealed. After the opening 1*a* is unsealed, the incompletely engaged engaging rib 20*a* is brought out of the interference sooner or later by the rotation of the main assembly driving portion 20 in the direction indicated by an arrow c, and therefore, correct locking of the engaging projection 3A is established. With further rotation, as shown in (C) of FIG. 18, the engaging rib 20*a* is engaged with the engaging projection 3B, so that rotation is transmitted to rotate the toner bottle 1.

By providing the number of engaging projections 3 which is at least one larger than the number of engaging ribs 20*a*, at least one of the engaging projections is engaged with the locking hole without an interference with the engaging rib irrespective of the position of the toner bottle 1 in the rotational direction. In this manner, the toner bottle 1 can be assuredly set in the apparatus.

The number of the engaging projections 3 may be four rather than two as in this embodiment. In that case, the number of the engaging ribs is not more than three.

Figure 35A:
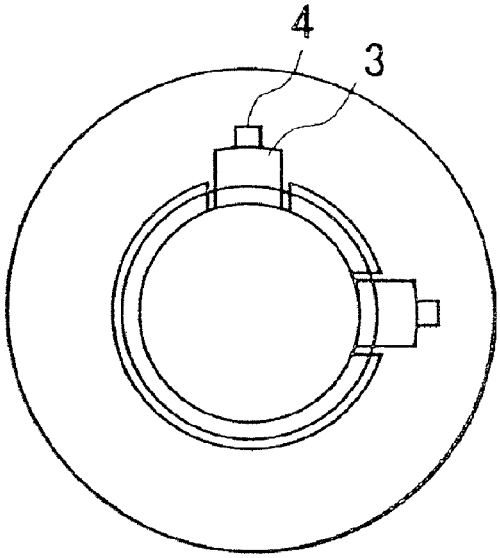
FIG. 35 illustrates another example in which the phase alignment is not required.
Figure 35B:
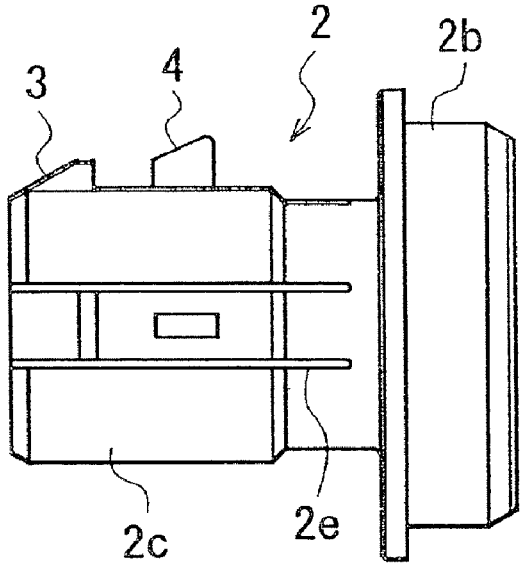
Figure 35C:
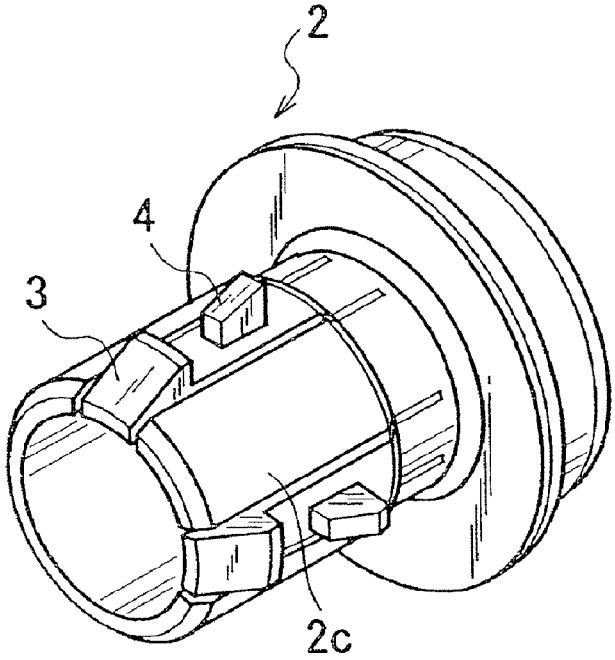
Figure 36A:
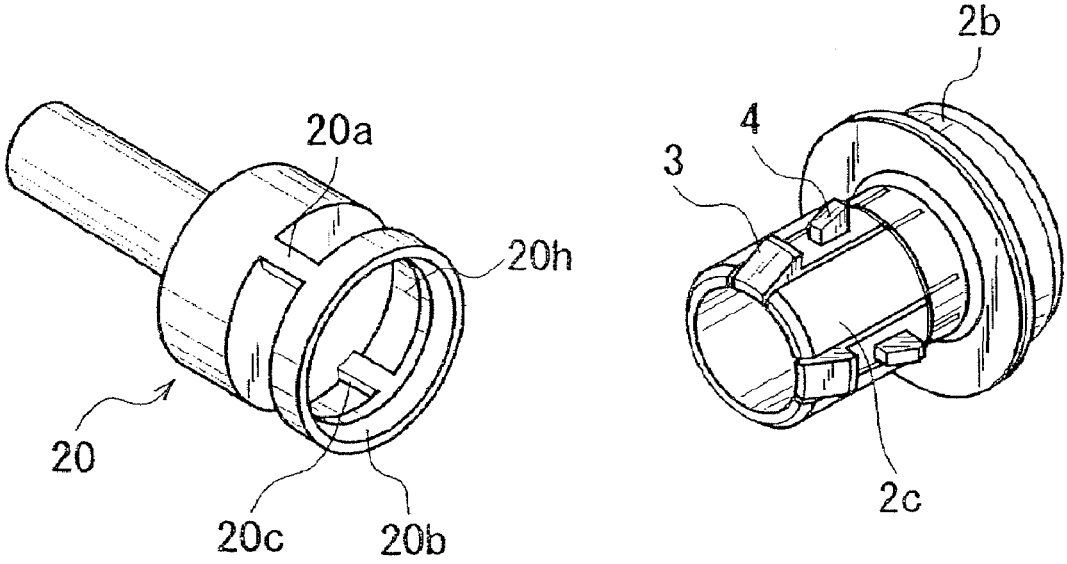
FIG. 36 is a section of viexv in which the sealing member shown in FIG. 35 is engaged with the driving portion.
Figure 36B:
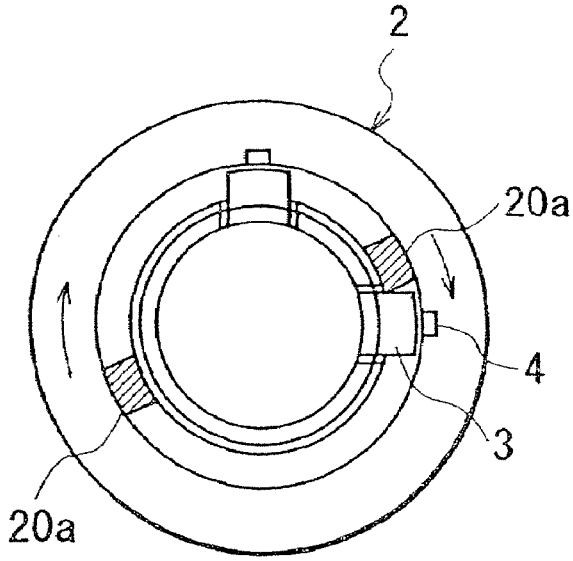

In this case, even if the number of the engaging ribs and the number of the engaging projections are the same, as shown in FIGS. 35 and 36, the distance (phase) between the engaging rib may be made different from the distance (phase) between the engaging projections, by which at least one engaging projections is not the line with the engaging rib upon the insertion of the bottle, so that correct looking can be accomplished there.

When a plurality of engaging ribs are provided at different circumferential position, it is preferable that engaging ribs are disposed at regular intervals in consideration of the drive transmission property.

Figure 20:
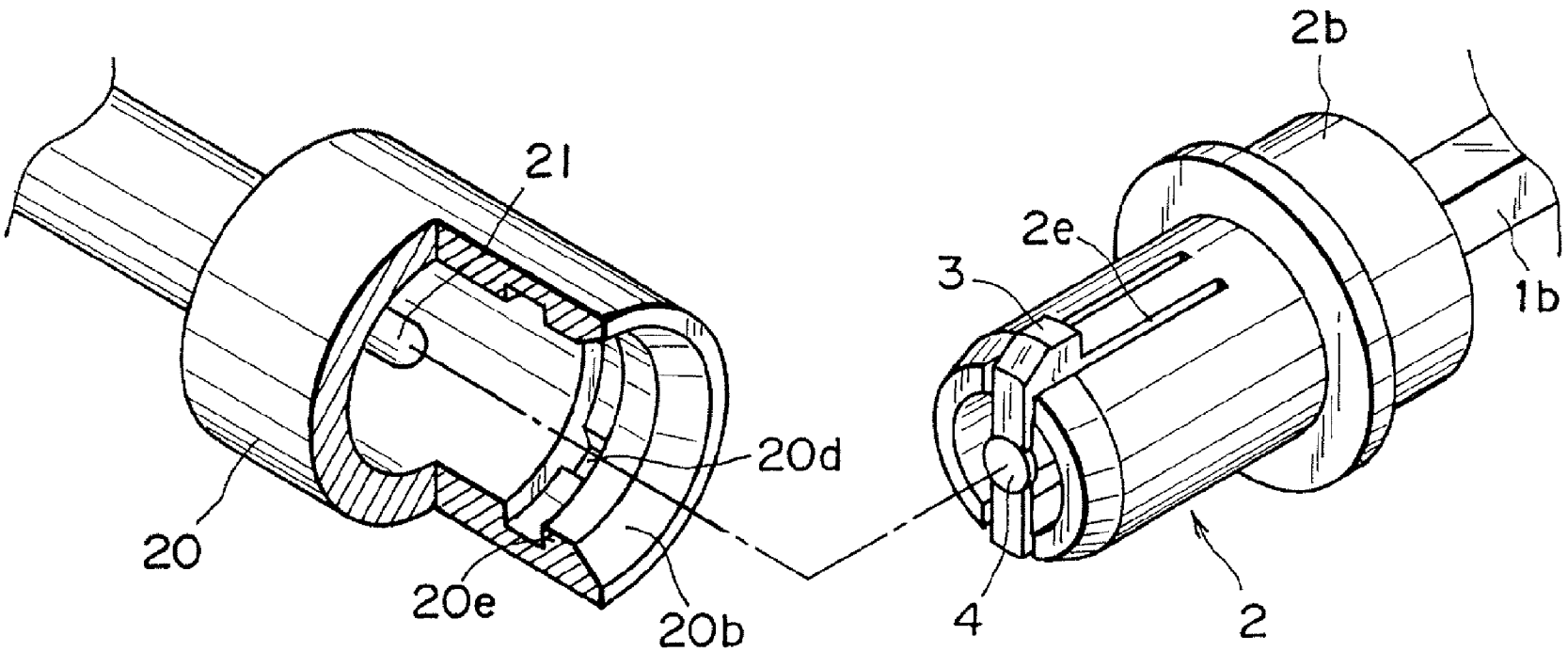
FIG. 20 is a perspective view of a driving force transmitting portion and a driving force receiving portion according to a further embodiment of the present invention, in which phase control operation is not necessary.

FIG. 20 shows another example which also eliminates the necessity for the phase alignment. In this modified example, a shallow locking groove 20*e* is extended in the entire inner circumference of the engaging portion 20*d* of the main assembly driving portion 20, and an engaging hole 20*d* for engagement with the engaging projection 3 is formed in the locking groove 20*e*. The locking groove 20*e* is not as deep as to completely engaged with the engaging projection 3, but is so shallow as to permit half engagement to permit automatic unsealing action.

Figure 21:
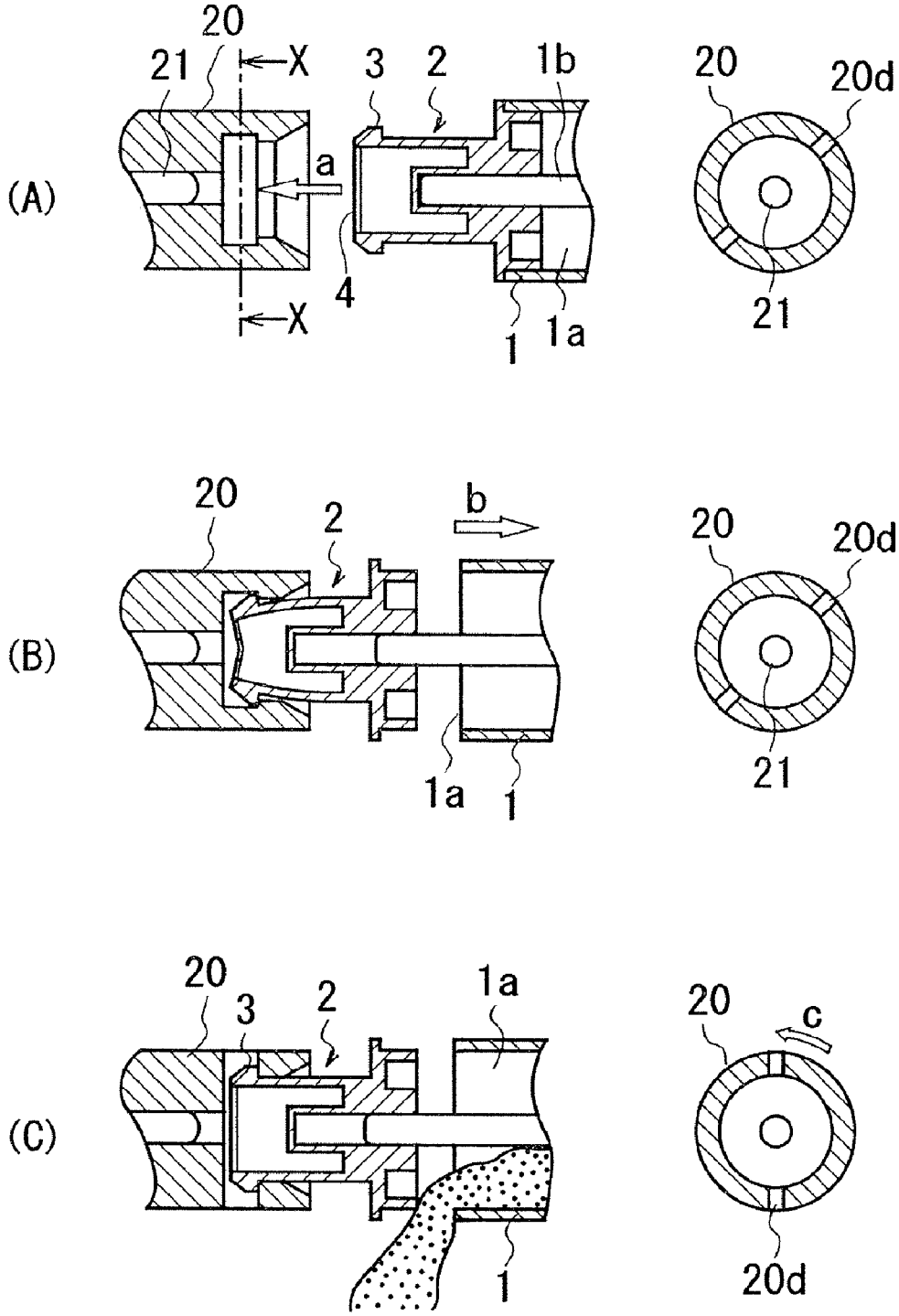
FIG. 21 illustrates the drive transmitting portion of FIG. 20 during a toner bottle inserting operation, wherein (A) shows a state before insertion of the toner bottle, (B) shows a state in the process of the inserting operation, and (C) shows a state after completion of the inserting operation.

Referring to FIG. 21, the operation upon the engagement in this modified example will be described.

In FIG. 21, (A) there is shown a state in which the toner bottle 1 has not yet been inserted into the main assembly driving portion 20, and the engaging hole 20*d* of the main assembly driving portion 20 and the engaging projection 3 sealing member 2 are not aligned in the positions in the rotational direction, as indicated in X-X cross-section. With the insertion of the toner bottle 1, the state shown in (B) of FIG. 21 is reached, in which the engaging projection 3 is half-engaged with the locking groove 20*e*. With the state, when the toner bottle 1 is retracted, only the toner bottle 1 is retracted in the direction indicated by the arrow b since the sealing member 2 is locked with the locking groove 20*e*, so that sealing member 2 and the toner bottle 1 are spaced apart with certainty to unseal the opening 1*a*. When the main assembly driving portion 20 rotates in the direction indicated by an arrow c, the engaging hole 20*d* and the engaging projection 3 are aligned as shown in (C) of FIG. 21, and the engaging projection 3 is now completely engaged with the engaging hole 20*d* to permit transmission of the rotational driving force.

In this manner, according to this embodiment, the toner bottle 1 can be properly set in the main assembly 100 of the apparatus simply by inserting the toner bottle 1 into the main assembly 100, without the necessity of adjusting the position of the bottle 1 in the rotational direction. Therefore, the exchange operation is simple and easy.

Additionally, since the opening and closing operation for the opening of the toner supply container is automatically executed in the main assembly of an image forming apparatus, and therefore, the user is not required to open or close the opening. This eliminates the possibility of contaminating the hands of the user.

(Releasing Method)

Figure 22:
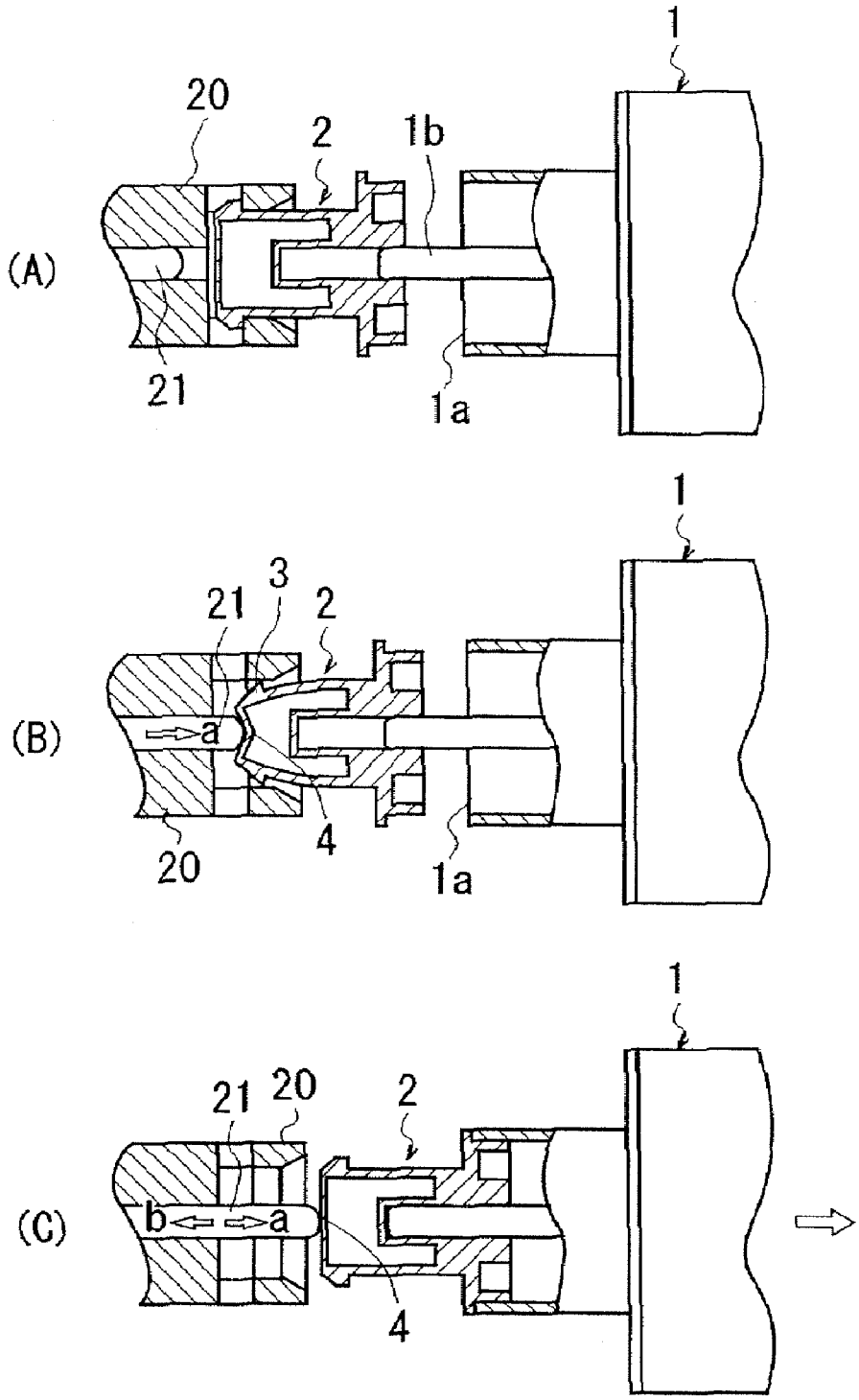
FIG. 22 illustrates disengagement action at the drive transmitting portion of the toner bottle, wherein (A) is before disengagement, (B) is in the process of disengagement, (C) is after completion of the disengagement action.

Referring to FIG. 22, the description will be made as to releasing between the engaging projection 3 and the main assembly driving portion 20.

When the toner supply is completed, and the toner bottle 1 becomes empty, the current toner bottle 1 is removed, and a new toner bottle is set.

At this time, it is necessary to release the sealing member 2 from the driving portion 20.

As shown in FIG. 22, the inside of the main assembly of the apparatus, more particularly, the inside of the driving portion 20 is provided with a pushing member 21. The pushing member 21 is movable in the same direction as the direction of the axis of the driving shaft 1*b* of the toner bottle 1.

In FIG. 22, (A) shows a state in which the toner supply is completed, and the opening 1*a* of the toner bottle 1 is in an open state.

When the locking between the driving portion 20 and the sealing member 2 is released, the pushing member 21 is announced in a direction indicated by an arrow a to the releasing portion 4 at the free end of the sealing member 2, by which the releasing portion 4 is elastically deformed in the same direction, and correspondingly, the engaging projection 3 integral with the releasing portion 4 the forms toward inside. By this, the engaging projection 3 is disengaged from the main assembly driving portion 20.

The pushing member 21 further advances in the direction of arrow a, by which the sealing member 2 is press-fitted into the opening 1*a*, thus resealing the opening 1*a* of the toner bottle 1. The pushing member 21 is even further advanced in the direction of arrow a, by which the toner bottle 1 per se is retracted to slide the toner bottle 1 to a position to facilitate the user who is going to remove it.

As for the driving structure for the pushing member 21, it may be interrelated with the opening and closing operation of the front cover 15 of the main assembly 100 of apparatus such that when the front cover 15 is opened, the pushing member 21 moves in the direction of arrow a to effect disengagement between the sealing member 2 of the toner bottle 1 and the driving portion 20, and when the front cover 15 is closed, it is advanced in the direction of arrow b. Alternatively, a driving motor or the like is used to effect the disengaging operation independently. In another alternative, it is not interrelated with the front cover 15 of the main assembly 100 of the apparatus, but a manual lever is provided, which is manipulated by the user and is interrelated with the pushing member.

As described in the foregoing, according to the embodiments, the toner supply container can be locked in the main assembly of the electrophotographic image forming apparatus by a snap fit type engagement with certainty by inserting the toner supply container. When it is to be taken out, the snap fit type locking is easily released by pushing the releasing portion. Thus, the supplying operation from the toner supply container is accomplished with a very simple operation. Accordingly, a toner supply container of high operativity can be provided.

In addition, the disengagement of the drive transmission for the toner supply container is simultaneously effected, and also the opening and closing operation for the opening can be simultaneously effected.

These advantageous effects can be provided by very simple action at low cost with compact structure and reliable drive transmission.

In the toner dischargeable state, it is not necessary to provide means for rotatably supporting the driving shaft 1*b* at the main body side of the toner bottle. This simplify the structure and avoids the problem of toner leakage, torque increase, production of coarse particles and so on.

Embodiment 2

Referring to FIGS. 23-25, 32, a second embodiment of the present invention will be described. The same reference numerals as with the first embodiment are assigned to the elements having the corresponding functions, and the detailed description of the common structure is omitted for simplicity.

Figure 23:
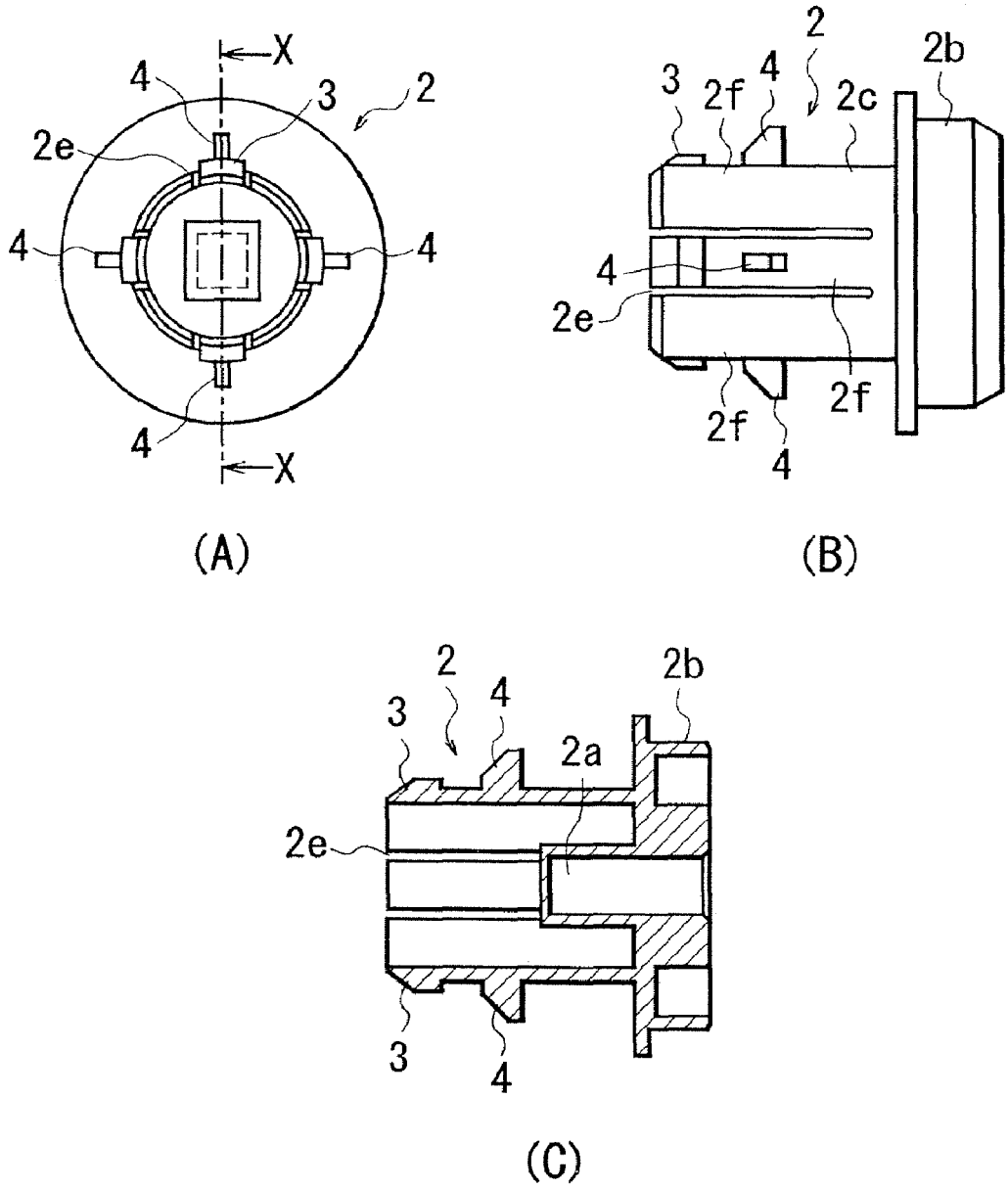
FIG. 23 is a sectional view of a sealing member according to a further embodiment of the present convention, wherein (A) is a side view, (B) is a front view, and (C) is a sectional view.

As shown in FIG. 23, in this embodiment, the releasing projection 4 (releasing portion) is provided on an outer surface not inside the cylindrical coupling engagement portion 2*c* of the sealing member 2 as in the first embodiment. In this embodiment, engaging projection 3 and the releasing portion 4 are provided at each of four circumferentially equidistant positions so as to constitute pairs. The structures of the driving portion 20 for locking engagement with the engaging projection of the sealing member is the same as with the Embodiment 1.

Figure 24:
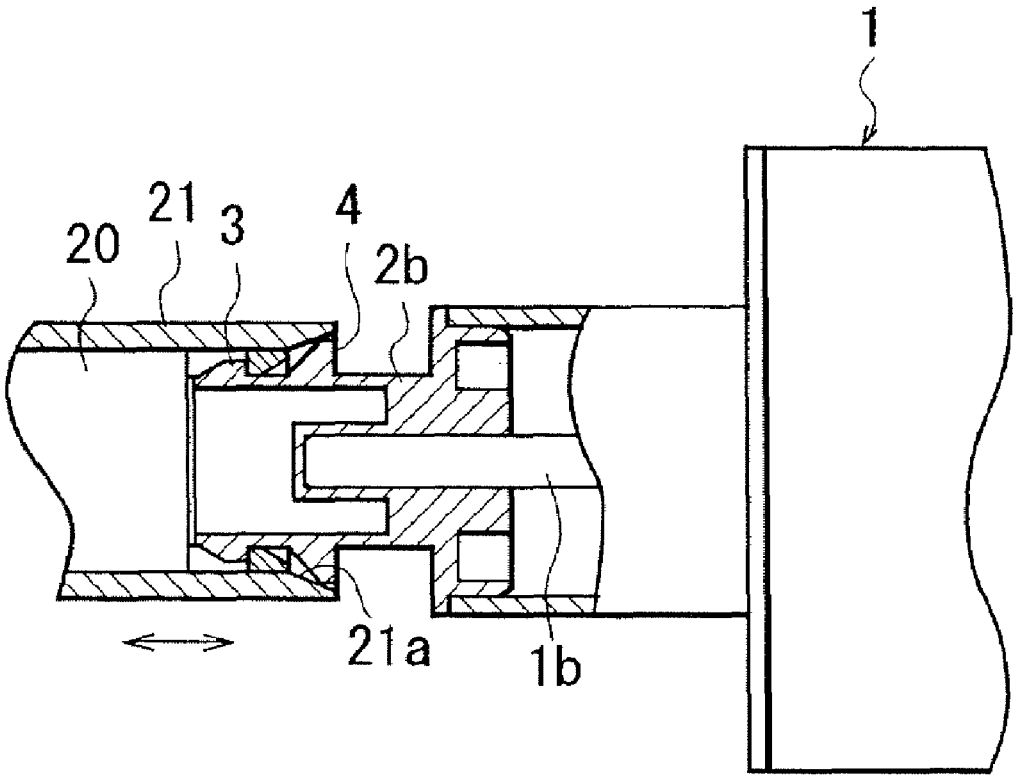
FIG. 24 is a sectional view illustrating engagement of the sealing member of FIG. 23 with a driving portion.

Correspondingly, the pushing member 21 is in the form of a cylinder covering the outside periphery of the driving portion 20 as shown in FIG. 24 and is slidable for engagement with the releasing portion 4, rather than a slidable rod as in the first embodiment. The inner surface of the free end portion of the pushing member 21 (cylindrical member) is tapered such that inner diameter increases, that is, the thickness of the cylinder reduces, toward the free end, by which the tapered portion 21*a* is engaged with the apex of the releasing portion 4 upon the engagement. Slits 2*e* are formed at the lateral sides of the supporting portion 2*f* for the engaging projection 3 and the releasing portion 4 to facilitate inward elastic deformation of the engaging projection 3 and the releasing portion 4 and restoration.

According to this embodiment, the entire sealing member can be integrally molded, and therefore, the production property of the sealing members is drastically improved, and the manufacturing cost can be reduced.

Figure 25:
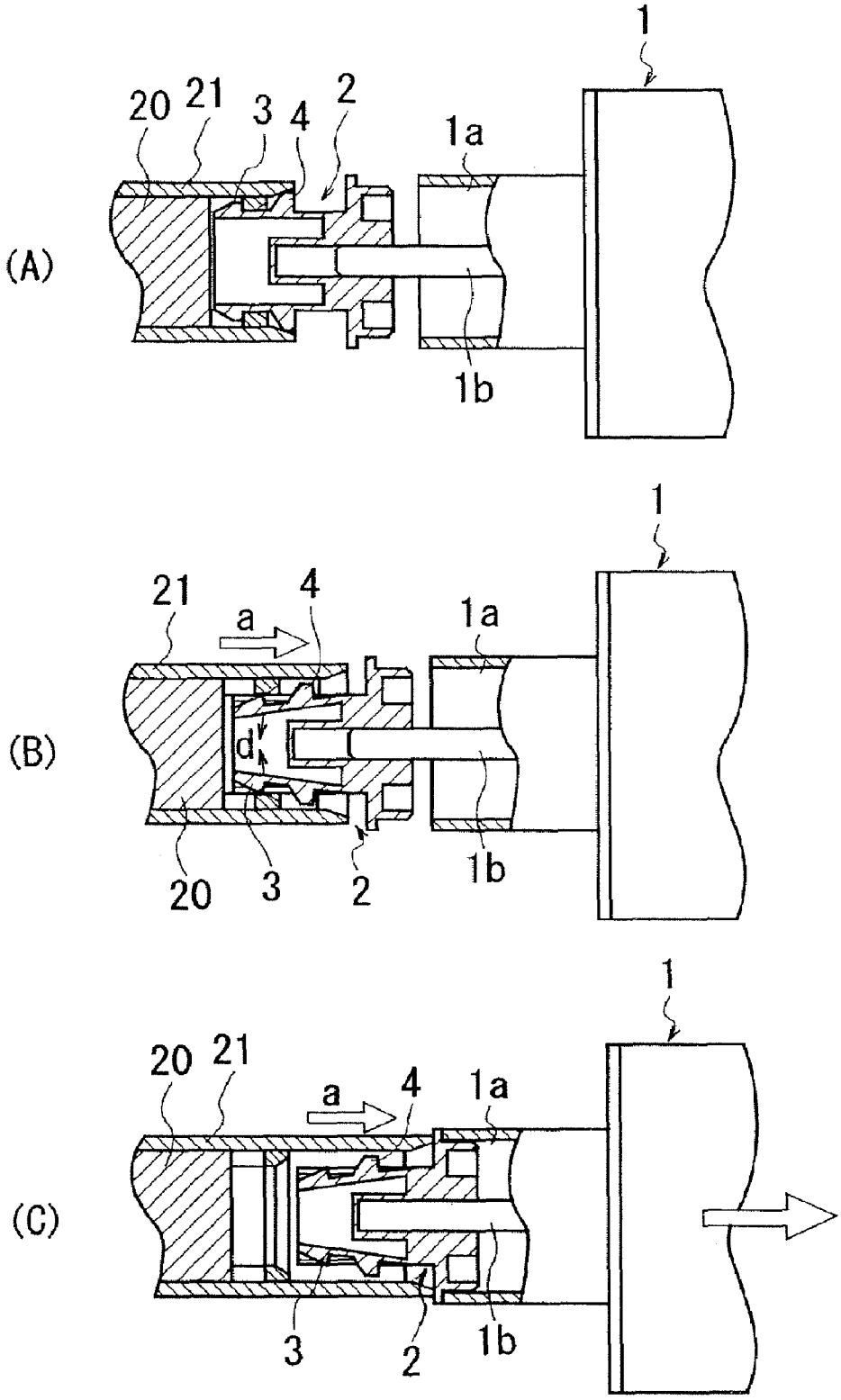
FIG. 25 is an illustration of disengagement action at the drive transmitting portion of the toner bottle, wherein (A) is before disengagement, (B) is in the process of disengagement, and (C) is after the completion of the disengagement action.

In FIG. 25, (A) shows a state in which the toner supply is completed, and the opening 1*a* of the toner bottle 1 is still open.

When the engagement between the main assembly driving portion 20 and the sealing member 2 are to be released, the pushing member 21 is advanced to the releasing portion 4, as shown in (B) in FIG. 25, so that releasing portion 4 is pressed inwardly by the inner surface of the pushing member 21. This displaces the releasing portion 4 inwardly (arrow d) by the elastic deformation of the supporting portion 2*f*, and simultaneously, the engaging projection 3 is displaced inwardly together with the releasing portion 4. By this, the engaging projection 3 is disengaged from the main assembly driving portion 20. The releasing steps are carried out in interrelation with the opening operation of the exchange cover by the operator.

Thereafter, the pushing member 21 is advanced in the direction of arrow a, so that sealing member 2 is returned to the sealing position of the toner bottle 1, as shown in (C) of FIG. 25. Subsequently, the pushing member 21 is further advanced to slide the toner bottle 1 per se to a position facilitating the user who is going to take the toner bottle 1 out.

As described in the foregoing, according to this embodiment, by the provision of the releasing portion 4 on the outer surface of the cylindrical portion 2*c*, the same advantageous effects as with the first embodiment described in the following can be provided. According to this embodiment, when the sealing member 2 is produced by injection molding of a resin material, the mold can be easily removed, and thus improving the production property.

A width of the engaging projection is larger than the width of the releasing projection, so that when the main body of the bottle is retracted for automatic unsealing of the opening, the engagement between the engaging projection (locking surface) and the driving portion 20 is maintained. The releasing projection does not have such a function, and therefore, the width is reduced to minimize the resin material cost in the manufacturing.

Figure 32:
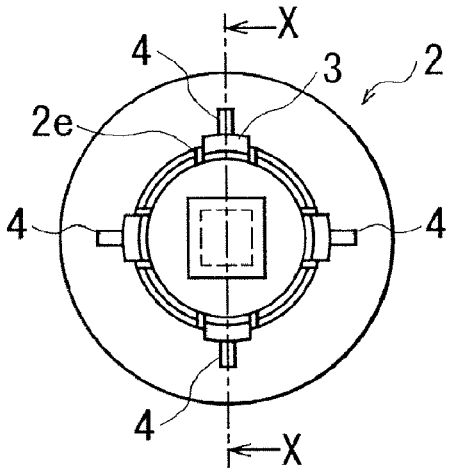
FIG. 32 shows a sealing member according to a modified embodiment of Embodiment 2.
Figure 32:
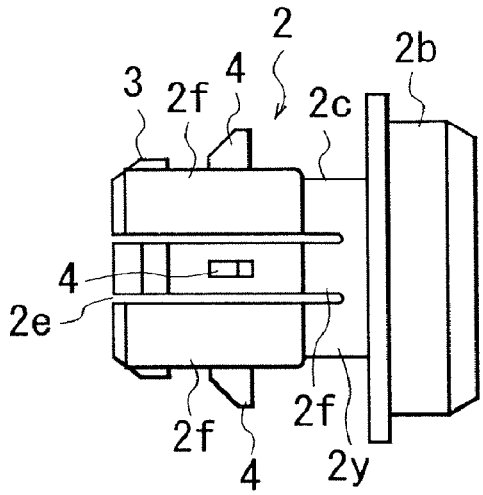
Figure 32:
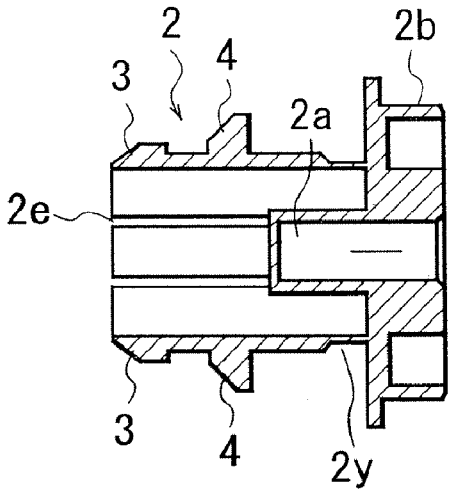

It is a possible alternative that thin portion 2*y* is provided as shown in FIG. 32 to make the base portions of the supporting portion 2*f* (supporting the engaging projection and the releasing projection) easy to deform. With this structure, the disengagement action is made sure while maintaining a sufficient rigidity of the sealing member including the engaging projection which receives the rotational driving force.

Embodiment 3

Referring to FIGS. 26 through 29, a third embodiment of the present invention will be described.

Figure 26:
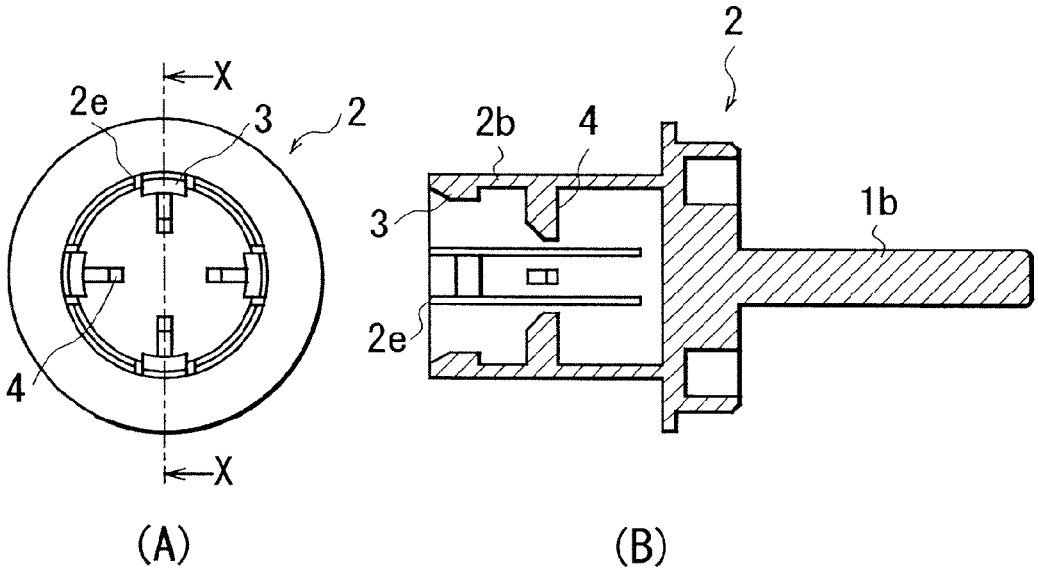
FIG. 26 illustrates a sealing member according to a further embodiment of the present invention, wherein (A) is a side view, and (B) is a sectional view taken along a line X-X.

In the second embodiment, as shown in FIG. 24, the engaging projection 3 and the releasing portion (releasing projection) 4 for the sealing member 2 are provided at the outer surface of the engaging portion 2*b*. In this embodiment, as shown in FIG. 26, the engaging projection 3 and the releasing projection 4 are provided at each of four circumferentially equidistant positions on an inner surface of the engaging portion 2*b*.

Figure 27:
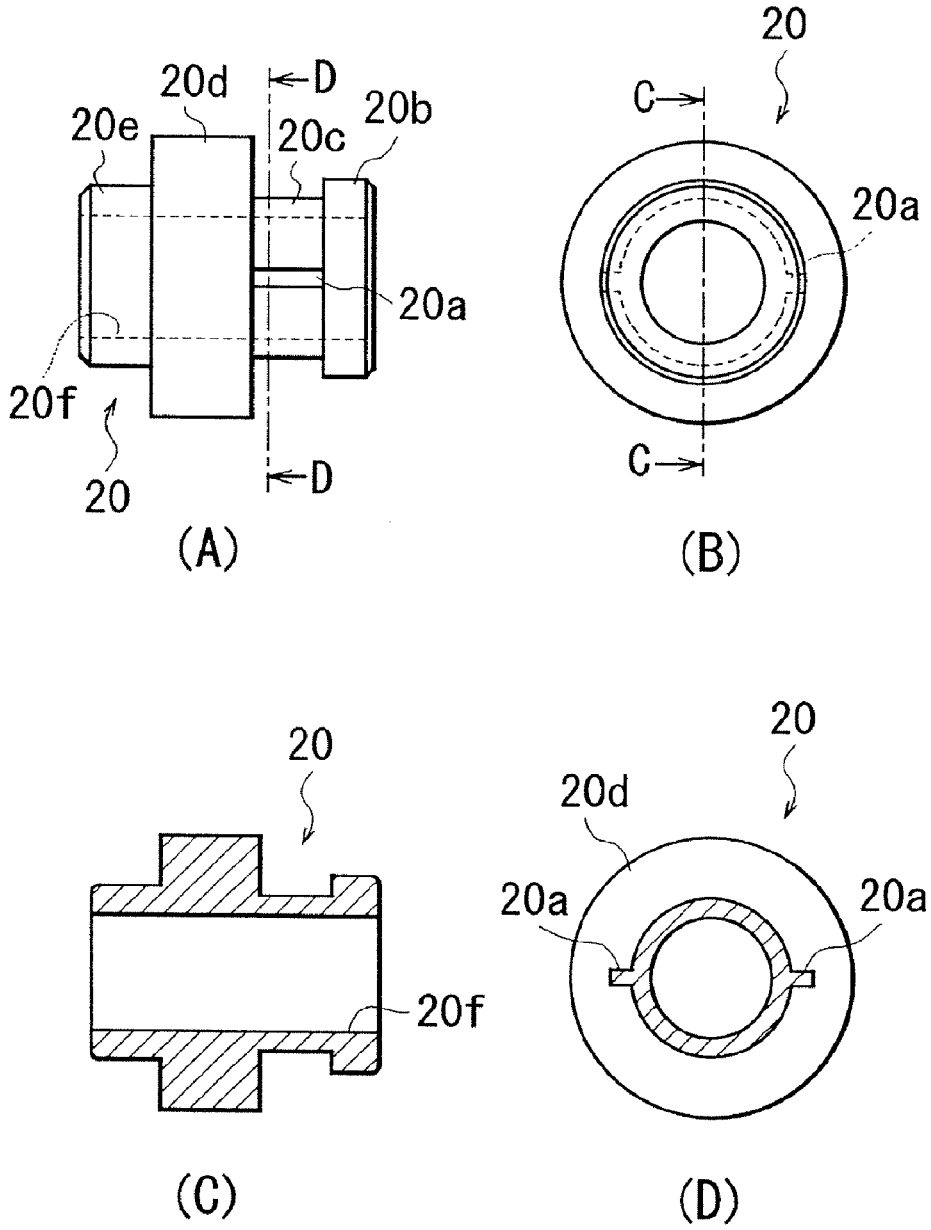
FIG. 27 shows a driving portion engageable with the sealing member of FIG. 26 according to a further embodiment of the present invention, wherein (A) is a front view, (B) is a side view, (C) is a sectional view taken along a line C-C of (B), (C) is a sectional view taken along a line D-D of (A).

Corresponding to such a structure of the sealing member 2, the main assembly driving portion 20 has a configuration shown in FIG. 27. The main assembly driving portion 20 comprises a cylindrical portions including a free end portion 20*b*, a small diameter portion 20*c*, a large diameter portion 20*d* and a rear end 20*e* which have different outer diameters. It also comprises a through-hole 20*f* through which the pushing member 21 is penetrated. The inner diameter of the through-hole 20*f* is constant. The small diameter portion 20*c* has a minimum outer diameter and is provided with an engaging rib 20*a* extending in the longitudinal direction of the driving portion 20 at each of the diametrically opposite positions.

Figure 28:
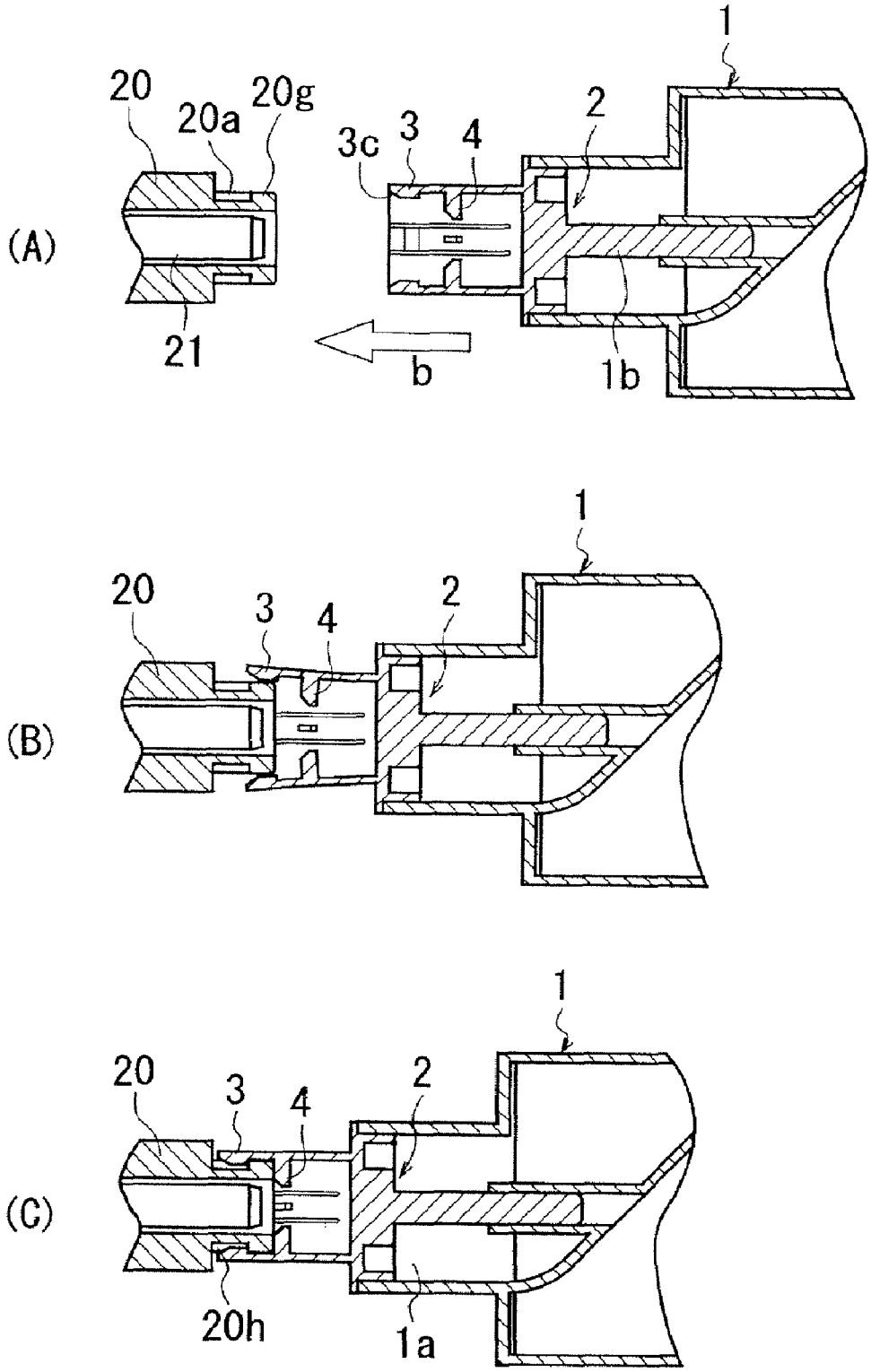
FIG. 28 illustrates engaging action between the sealing member of FIG. 26 and the driving portion of FIG. 27, wherein (A) shows a state in which the toner bottle is being inserted, (B) shows a state in the process of insertion, and (C) shows a state after the completion of insertion.

Referring to FIG. 28, the description will be made as to engagement between the driving portion 20 and the sealing member 2 in this embodiment.

In FIG. 28, (A) shows a state in which the toner bottle 1 is inserted in a direction indicated by an arrow b for a user to install a new toner bottle 1 into the main assembly of apparatus, in which the toner bottle 1 is not yet been locked with the driving portion 20 provided in the main assembly of apparatus.

As shown in (B) of FIG. 28, when the toner bottle 1 is further inserted, the engaging projection 3 provided in the sealing member 2 is brought into contact with the main assembly driving portion 20 and is guided by the tapered surface 3*c* formed at the free end portion of the engaging projection 3, and is gradually and elastically deformed.

With further insertion, the engaging projection 3 having passed by the straight portion 20*g*, as shown in (C) of FIG. 28, the forced deformation is released by the space portion 20*h* not having the engaging rib 20*a*, and the engaging projection 3 is firmly locked with the main assembly driving portion 20.

In the state shown in (C) of FIG. 28, the engaging projection 3 is firmly engaged with the main assembly driving portion 20 such that position of the sealing member 2 in the thrust direction (axial direction) is fixed relative to main body of the toner bottle 1. Therefore, when the toner bottle 1 is retracted thereafter, the sealing member 2 is not retracted together with the toner bottle 1 but is firmly fixed to the main assembly driving portion 20. On the other hand, only the toner bottle 1 is destructive, the sealing member 2 becomes away from the toner bottle 1 the unseal or open the opening 1*a*. The retracting operation of the toner bottle 1 may be such that toner bottle 1 is slid in interrelation with the opening and closing operation of the front cover 15 (FIG. 2).

Figure 29:
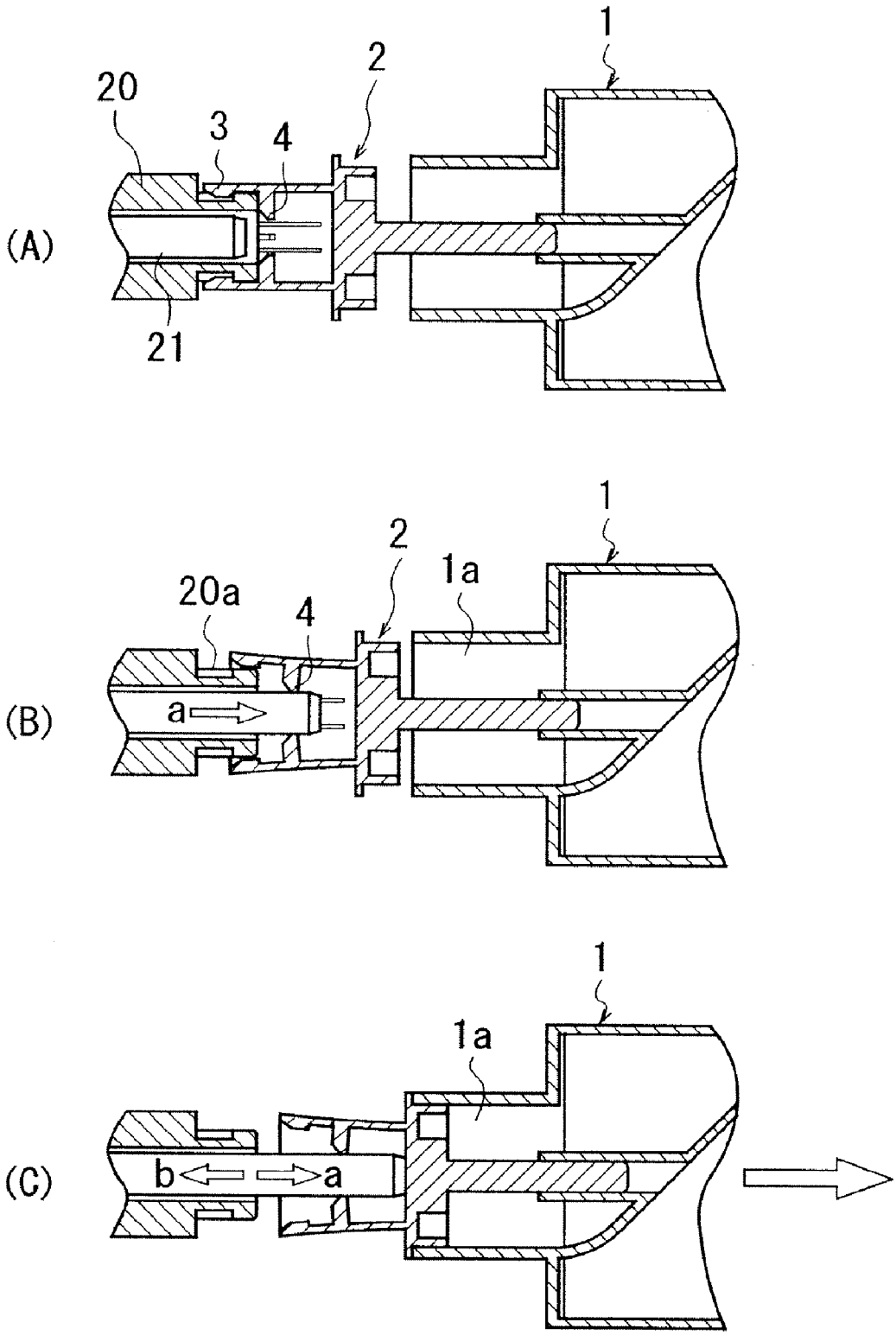
FIG. 29 illustrates disengagement action after the engagement shown in FIG. 28, wherein (A) is before the disengagement, (B) is in the process of the disengagement, and (C) is after completion of the disengagement action.

Referring to FIG. 29, the releasing or disengaging action in this embodiment will be described.

When the sealing member 2 is to be disengaged from the main assembly driving portion 20, the pushing member 21 disposed at the central portion of the main assembly driving portion 20 is slid in the direction of arrow a, and only by which it is disengaged from the main assembly driving portion 20.

By advancing the pushing member 21 in the direction of arrow a relative to the releasing portion 4 provided in the inside of the sealing member 2, the part supporting the releasing portion 21, as shown in (B) of FIG. 29, deforms outwardly so that releasing portion displaces outwardly, and therefore, the engaging projection 3 displaces outwardly. By this, the engaging projection 3 is disengaged from the main assembly driving portion 20.

With further advancement of the pushing member 21 in the direction of arrow a, the sealing member 2 is press-fitted into the opening 1*a* as shown in (C) of FIG. 29. In this position, the sealing member 2 unnseals the opening 1*a* of the toner bottle 1. By further advancement of the pushing member 21 in the direction of arrow a, the toner bottle 1 per se is slid backward to a position where the user can easily take the toner bottle 1 out.

As for the driving structure for the pushing member 21, it may be interrelated with the opening and closing operation of the front cover 15 of the main assembly 100 of apparatus such that when the front cover 15 is opened, the pushing member 21 moves in the direction of arrow a to effect disengagement between the sealing member 2 of the toner bottle 1 and the driving portion 20, and when the front cover 15 is closed, it is advanced in the direction of arrow b. Alternatively, a driving motor or the like is used to effect the disengaging operation independently. In another alternative, it is not interrelated with the front cover 15 of the main assembly 100 of the apparatus, but a manual lever is provided, which is manipulated by the user and is interrelated with the pushing member.

In this embodiment, not releasing portion is not exposed to outside, and therefore, in case that toner supply container is unintentionally let fall, the releasing portion is not damaged, and therefore, the shock resistant property is high during the transportation.

In addition, by a very simple sliding of the pushing member in the forward and backward directions, the drive transmission of the toner bottle can be easily disengaged, and simultaneously, the opening and closing of the opening of the toner bottle can be accomplished.

These advantageous effects can be provided by very simple action at low cost with compact structure and reliable drive transmission.

Embodiment 4

Figure 30:
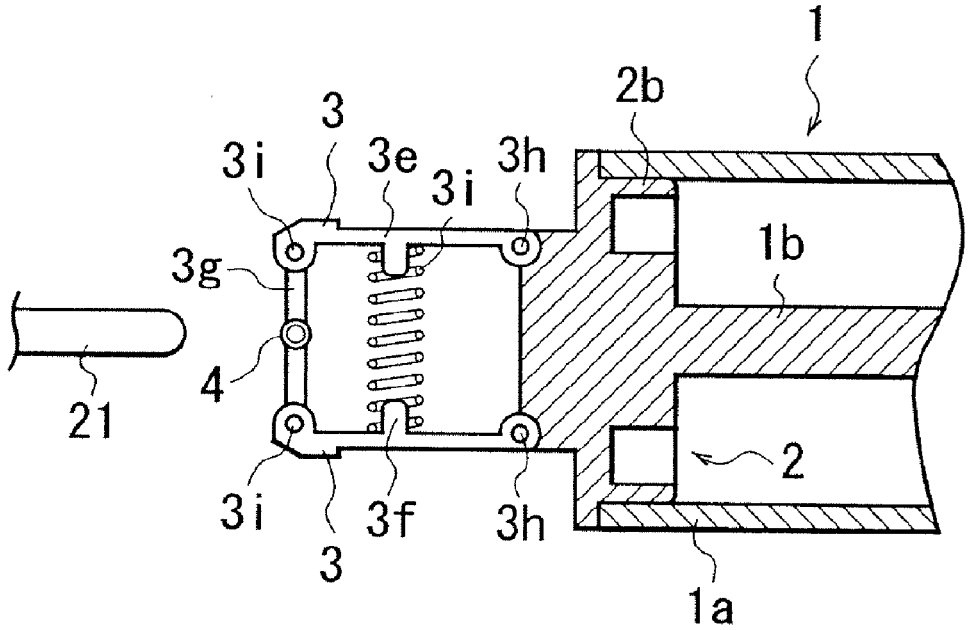
FIG. 30 is a sectional view of a sealing member according to a further embodiment of the present invention, wherein (A) is before disengagement, and (B) is in the process of disengagement.
Figure 30:
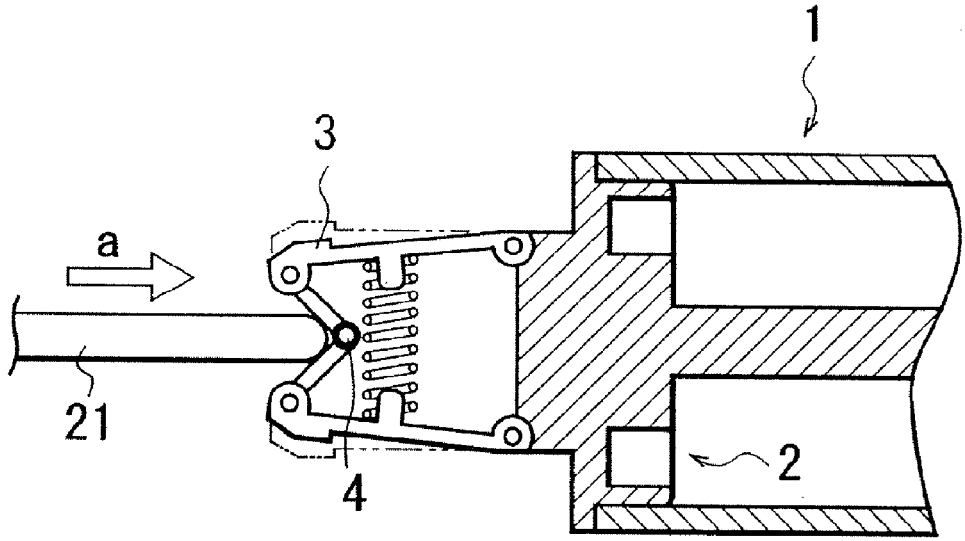

Referring to FIG. 30, a fourth embodiment of the present invention will be described.

In this embodiment, as shown in FIG. 30, a sealing member 2, an engaging projection 3 and a releasing portion 4 mounted to the opening 1*a* of the toner bottle 1 are manufactured separately with respective to each other, and then they are assembled.

As shown in this Figure, two movable arms 3*e* are mounted by hinge portions 3*h* on the end surface of the sealing member 2 such that they are opposed to each other. Each of the movable arm 3*e* is provided at its free end portion with an engaging projection 3 for effect with the engagement which is similar to that in the first embodiment.

The engaging projections 3 are connected with each other by a link 3*g* through hinge portions 31. The link 3*g* includes two members connected by a hinge which function as a releasing portion 4.

From an inside of the movable arm 3*e* fixed projections 3*f* are projected opposed to each other at a central portion. A spring 3*j* compressed between the fixed projections 3*f*. By the urging force provided by the spring 3*j*, the movable arm 3*e* urged outwardly, so that engaging projection 3 is engageable with the main assembly driving portion 20 as shown in (A) of FIG. 30. The main assembly driving portion 20 suitable in this embodiment is for example that shown in FIG. 14.

With such a structure, when the toner bottle 1 is to be engaged with the main assembly driving portion 20 by the engaging projection 3, it is enough to insert the toner bottle 1 into the main assembly of apparatus, similarly to Embodiment 1. More particularly, when the toner bottle 1 is inserted, the engaging projections 3 are brought into contact with the main assembly driving portion 20, by which the movable arms 3*e* are tilted inwardly against the spring force of the spring 3*j* together with the engaging projections 3. With further insertion, the engaging projection 3 are engaged with the main assembly driving portion 20 at a predetermined position by the spring force of the spring 3*j*, and simultaneously, the movable arms 3*e* restore the original position shown in (A) of FIG. 30.

On the other hand, when they are to be disengaged from each other, as shown in (B) of FIG. 30, the pushing member 21 is pushed against the releasing portion 4 in a direction indicated by an arrow a, the engaging projections 3 are easily tilted, so that they are disengaged.

Similarly to the following embodiments, the structure of this embodiment also provides the same advantageous effects.

In this embodiment, the elastic deformation is not use, the engaging projection 3 may be made of any material not exhibiting elastic deformation per se, and therefore, the choice of the material is very big. For example, various materials such as aluminum, a steel or magnesium, or wood, hard resin material or the like is usable. A higher engagement strength can be maintained, and the durability is improved.

The parts are connected with linking mechanism, which provides larger movable range than the elastic deformation, and therefore, a larger engagement area is usable. Therefore, the engagement is very firm with high reliability.

In this embodiment, the elastic deformation of the sealing member is not utilize unlike Embodiments 1-3, but a link type is employed. Therefore, the durability is better, but the structure is rather complicated with the possible result of cost increase.

Embodiment 5

The present invention is not limited to the foregoing Embodiments. In Embodiment 5, the structures are the same as that of said embodiment (FIG. 20) except for the portions which will be described.

Figure 31:
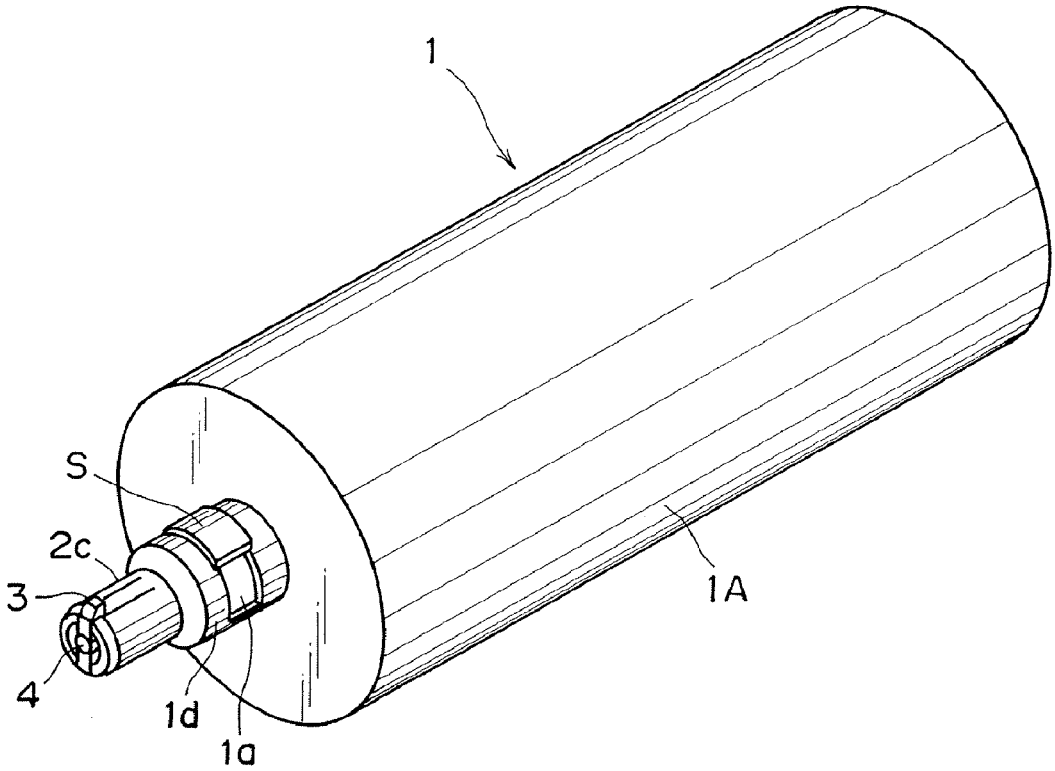
FIG. 31 is a perspective view of a toner supply container according to a further embodiment of the present invention.

For example, as shown in FIG. 31, the opening 1*a* of the toner bottle 1 may be provided in the cylindrical surface 1*d* adjacent the longitudinal end surface. In such a case, the coupling engagement portion 2*c* is not provided in the sealing member 2 and may be mounted rotatably in an end surface of the main body 1A of the toner bottle. In this case, the opening 1*a* is unsealably sealed by a shutter member S.

The coupling engagement portion 2*c* as a function of locking the main body 1A of the toner bottle with the main assembly (driving portion 20 shown in FIG. 20) of the image forming apparatus by a locking portion (locking surface of the engaging projection 3), a function of receiving a rotational driving force from the main assembly side of the image forming apparatus by a driving force receiving portion (a drive receiving surface of the engaging projection 3), a function of disengaging the main body 1A of the toner bottle from the main assembly (driving portion 20) of the image forming apparatus by a releasing portion 4, and a function of transmitting the driving force received by the driving force receiving portion to the coupling engagement portion 2*c* and the toner feeding member fixed in the toner bottle. With this structure, a force of separating the toner bottle from the driving portion 20 of the main assembly of apparatus for some reason or another, while the rotation is received from the main assembly of apparatus, they are maintained engaged with each other, and therefore, it is avoided that transmission of the rotational driving force to the toner bottle is unintentionally disengaged.

Embodiment 6

Figure 33:
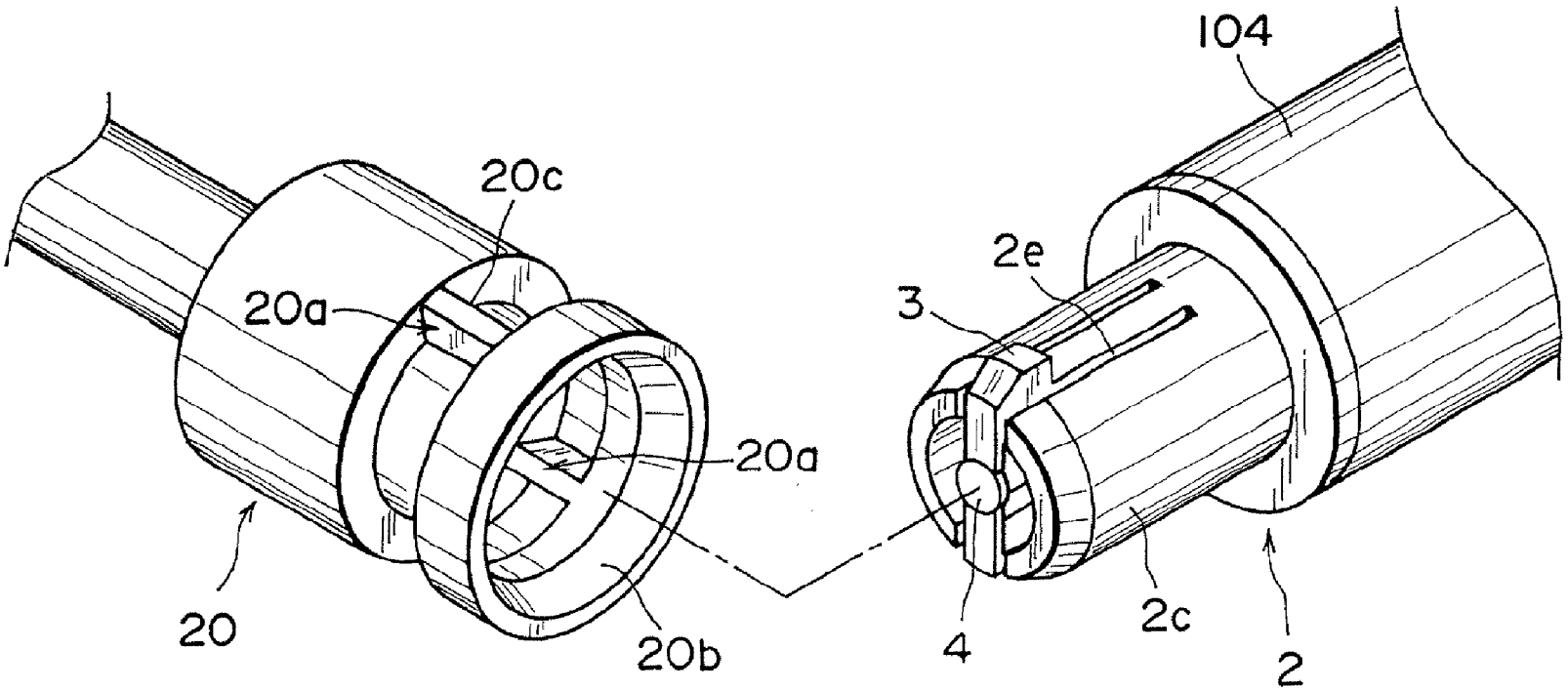
FIG. 33 is a perspective view illustrating a drive transmission for a photosensitive drum according to a further embodiment of the present invention.

Referring to FIG. 33, a sixth embodiment will be described.

In the foregoing embodiment, the locking mechanism, the releasing mechanism and the drive transmission mechanism are used between an image forming apparatus and a toner supply container (sealing member). In this embodiment, the use is made between an image forming apparatus and an electrophotographic photosensitive member detachably mountable relative to the main assembly of the image forming apparatus, in which the photosensitive drum is exchanged with a new one after the service life. In the other aspects, the structures are the same as with Embodiment 1.

In FIG. 33, the coupling engaging portion 2*c* provided at an end of a photosensitive drum 104 is engaged with a driving portion 20 of the main assembly of the image forming apparatus similarly to Embodiment 1, so that rotational driving force is transmitted from the driving portion 20 to the photosensitive member. The structures for the disengagement therebetween is similar to that of Embodiment 1.

As will be understood, the drive transmission mechanism of this invention is not limited to the toner supply container or the image forming apparatus, but is applicable to a structure for transmitting rotational, swing or reversing motion about a rotation axis.

The automatic sealing operation for the opening may be accomplished in the following manner.

In interrelation with and opening operation of the exchange cover by the operator, the main body of the toner bottle is advanced toward the sealing member with the engagement between the sealing member and the driving portion 20 maintained, by which the sealing member is press-fitted into the opening, thus accomplishing automatic sealing.

Thereafter, the pushing member 21 slides to be contacted into the releasing portion, and the engaging projection is disengaged from the driving portion 20. Furthermore, the pushing member 21 pushes the main body of the toner bottle together with the sealing member toward the change cover to a position where the-operator can easily take the toner bottle out.

In this manner, the sliding movement (retraction, advancement) of the main body of the bottle used for unsealing the opening can be used for resealing the open with a simple structure. In addition, the slide movement distance of the pushing member can be made shorter than in the foregoing embodiments, and therefore, complication of the apparatus at the main body side can be avoided.

The structure for the engagement and disengagement between the main assembly of the image forming apparatus and the toner bottle or the photosensitive member may be used in Embodiments 2, 3 and 4.

In Embodiments 1-6, only by the movement of the releasing projection of the main assembly of apparatus in a direction (axial direction, for example) of relative motion of the sealing member relative to the main body, the engaging projection or projections are moved in a direction or directions substantially perpendicular to the direction (radial direction, for example), and therefore, the structure for the disengagement is simple. Even when a plurality of engaging projections are provided, all the engaging projections are brought into disengaging positions by a force applied substantially at one position, and therefore, the structure for the disengagement is simple. In Embodiments 1, 4, 5 and 6, the releasing force receiving portion of the sealing member is disposed substantially at the free end portion of the sealing member, so that releasing force receiving portion can be engaged with the main assembly at a relatively early stage after the start of insertion of the toner bottle.

In embodiments 1-4, the driving portion 20 provided in the main assembly of the image forming apparatus is provided with a locking hole and an engaging rib, and the sealing member 2 is provided with an engaging projection portion 3 engageable with the locking hole and the engaging rib of the driving portion 20, but the projection and recess relationship may be reverse. In other words, the driving portion 20 of the main assembly of the apparatus is provided with the engaging projection and the releasing portion (releasing projection), and the sealing member 2 is provided with the locking hole and the engaging rib. With such a structure, the same advantageous effects are provided.

As described in the foregoing, according to these embodiments, the toner accommodating container and the main assembly of the image forming apparatus are locked in a snap fit type engagement, and the sealing member can be automatically engaged into or disengaged from the opening of the toner accommodating container, wherein the locking engagement can be released with a simple structure without load on the user.

Therefore, the toner supply operation can be carried out by the user with much less load.

Such a sealing member, a toner accommodating container and an image forming apparatus can be provided at low cost.

While the invention has been described with reference to the structures disclosed herein, it is not confined to the details set forth and this application is intended to cover such modifications or changes as may come within the purpose of the improvements or the scope of the following claims.

What is claimed is:

1. A toner supply container detachably mountable to an image forming apparatus including a hollow cylindrical member provided with a through hole and a rib disposed at a circumferential end of the through hole, the container comprising:

a toner containing portion for containing toner;

a coupling member for receiving a rotational driving force from the cylindrical member, said coupling member including first and second engaging projections engageable with the through hole and first and second supporting portions for supporting, for substantially radially inward displacement with elasticity, said first and second engaging projections respectively, wherein said first and second supporting portions are made of elastically deformable resin material, wherein when said first supporting portion is in a state of interfering with the rib without said second supporting portion interfering with the rib, said first supporting portion restores substantially radially outwardly with rotation of the cylindrical member.

2. A toner supply container detachably mountable to an image forming apparatus including a hollow cylindrical member provided with a through hole and a rib disposed at a circumferential end of the through hole, the container comprising:

a toner containing portion for containing toner;

a coupling member for receiving a rotational driving force from the cylindrical member, said coupling member including first and second engaging projections engageable with the through hole and first and second supporting portions for supporting, for substantially radially inward displacement, said first and second engaging projections respectively, wherein said coupling member includes urging means for substantially radially outwardly urging said first and second supporting portions, wherein when said first supporting portion is in a state of interfering with the rib without said second supporting portion interfering with the rib, said first supporting portion is displaced substantially radially outwardly with rotation of the cylindrical member.

* * * * *

UNITED STATES PATENT AND TRADEMARK OFFICE

CERTIFICATE OF CORRECTION

PATENT NO. : 7,376,369 B2
APPLICATION NO. : 11/567976
DATED : May 20, 2008
INVENTOR(S) : Yusuke Yamada et al.

It is certified that error appears in the above-identified patent and that said Letters Patent is hereby corrected as shown below:

TITLE PAGE [57] ABSTRACT

Line 9, “to” should be deleted.

COLUMN 1

Line 22, “particles” should read --particle--.
Line 32, “a,” should be deleted.
Line 53, “recesses” should read --recess--.

COLUMN 2

Line 13, “other” should read --order--.
Line 17, “inexpensive.” should read --expensive.--.

COLUMN 5

Line 20, “viexv” should read --view--.

COLUMN 7

Line 14, “its” should be deleted.

COLUMN 8

Line 6, “evening” should read --even in--.

COLUMN 10

Line 6, “feature” should read --feature of--.
Line 13, “is buffle” should read --a baffle--.
Line 15, “buffle” should read --baffle--.
Line 22, “buffle” should read --baffle--.
Line 23, “buffle” should read --baffle--.
Line 34, “is” should read --which is--.
Line 36, “buffle” should read --baffle--.
Line 39, “buffle” should read --baffle--.

COLUMN 11

Line 2, “its” should be deleted.

COLUMN 12

Line 33, “in general” should read --integral--.
Line 45, “deformable” should read --deform--.

UNITED STATES PATENT AND TRADEMARK OFFICE

CERTIFICATE OF CORRECTION

PATENT NO. : 7,376,369 B2
APPLICATION NO. : 11/567976
DATED : May 20, 2008
INVENTOR(S) : Yusuke Yamada et al.

It is certified that error appears in the above-identified patent and that said Letters Patent is hereby corrected as shown below:

COLUMN 13
Line 21, “the” should be deleted.

COLUMN 15
Line 6, “arrow” (first occurrence) should be deleted.

COLUMN 16
Line 58, “engaged” should read --engage--.

COLUMN 18
Line 49, “is” should read --are--.

COLUMN 19
Line 7, “are” should read --is--.
Line 32, “and” should be deleted.

COLUMN 21
Line 15, “not releasing” should read --the non-releasing--.
Line 17, “let fall,” should read --allowed to fall,--.
Line 41, “arm” should read --arms--; and “its” should read --their--.
Line 42, “for effect with” should read --to effect--.
Line 66, “are” should read --is--.

COLUMN 22
Line 13, “use,” should read --used,--.
Line 27, “not utilize” should read --not utilized--.

UNITED STATES PATENT AND TRADEMARK OFFICE

CERTIFICATE OF CORRECTION

PATENT NO. : 7,376,369 B2
APPLICATION NO. : 11/567976
DATED : May 20, 2008
INVENTOR(S) : Yusuke Yamada et al.

It is certified that error appears in the above-identified patent and that said Letters Patent is hereby corrected as shown below:

COLUMN 23

Line 21, "is" should read --are--; and "that" should read --those--.

Signed and Sealed this

Second Day of December, 2008

JON W. DUDAS
*Director of the United States Patent and Trademark Office*